US009984516B2

(12) United States Patent
Geerlings et al.

(10) Patent No.: US 9,984,516 B2
(45) **Date of Patent: *May 29, 2018**

(54) SYSTEMS AND METHODS FOR ADDING A TRAINABLE TRANSCEIVER TO A VEHICLE

(71) Applicant: GENTEX CORPORATION, Zeeland, MI (US)

(72) Inventors: Steven L. Geerlings, Holland, MI (US); Thomas S. Wright, Holland, MI (US); Todd R. Witkowski, Zeeland, MI (US); Bradley R. Hamlin, Allendale, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/618,760

(22) Filed: Feb. 10, 2015

(65) Prior Publication Data

US 2015/0228132 A1 Aug. 13, 2015

Related U.S. Application Data

(60) Provisional application No. 61/938,501, filed on Feb. 11, 2014.

(51) Int. Cl.
*G07C 9/00* (2006.01)
*G08C 17/02* (2006.01)

(52) U.S. Cl.
CPC ..... *G07C 9/00126* (2013.01); *G07C 9/00309* (2013.01); *G07C 9/00857* (2013.01);
(Continued)

(58) Field of Classification Search
CPC G08C 17/02; G08C 2201/20; G07C 9/00857; G07C 9/00126; G07C 9/00309
See application file for complete search history.

(56) References Cited

U.S. PATENT DOCUMENTS 5,033,112 A * 7/1991 Bowling ..... G02B 6/32 340/12.39
5,614,891 A 3/1997 Zeinstra et al.
(Continued)

FOREIGN PATENT DOCUMENTS

DE 1020100 15 104 A1 10/2011

OTHER PUBLICATIONS

International Search Report and Written Opinion of the International Searching Authority in PCT/US2015/015262 dated Jul. 2, 2015, 10 pages.
(Continued)

*Primary Examiner* — Nabil Syed
(74) *Attorney, Agent, or Firm* — Foley & Lardner LLP; Bradley D. Johnson

(57) ABSTRACT

A trainable transceiver base station for controlling a remote device includes a first transceiver circuit, a power connection, and a control circuit. The first transceiver circuit is configured to transmit activation signals to the remote device, the activation signals formatted based on training information and formatted to control the remote device. The power connection is configured to receive electrical power from a vehicle. The control circuit is configured to cause the first transceiver circuit to transmit the activation signal when a command signal is received at the trainable transceiver base station. The trainable transceiver base station is located at a first location within the vehicle, and the trainable transceiver base station is configured to receive the command signal from a remote button module located at a second location within the vehicle.

20 Claims, 25 Drawing Sheets

(52) U.S. Cl.
CPC ..... *G08C 17/02* (2013.01); *G07C 9/00182* (2013.01); *G07C 2009/00769* (2013.01); *G07C 2009/00849* (2013.01); *G07C 2009/00888* (2013.01); *G07C 2009/00928* (2013.01); *G08C 2201/20* (2013.01)

(56) References Cited

U.S. PATENT DOCUMENTS

| | | | | |
|---|---|---|---|---|
| 2004/0185844 | A1 | 9/2004 | Neuman | |
| 2006/0232376 | A1 | 10/2006 | Blaker | |
| 2008/0291047 | A1 | 11/2008 | Summerford et al. | |
| 2010/0134240 | A1* | 6/2010 | Sims | G08C 17/02 340/5.1 |
| 2010/0144284 | A1 | 6/2010 | Chutorash et al. | |
| 2012/0003935 | A1* | 1/2012 | Lydon | G06F 13/387 455/41.2 |
| 2012/0083209 | A1* | 4/2012 | Giles | H04W 12/04 455/41.2 |
| 2012/0126942 | A1* | 5/2012 | Geerlings | G07C 9/00857 340/5.61 |
| 2015/0099466 | A1 | 4/2015 | Narendra et al. | |

OTHER PUBLICATIONS

U.S. Office Action on U.S. Appl. No. 14/618,809 dated Mar. 4, 2016.
International Preliminary Report on Patentability and Transmittal received in PCT/US2015/015262 dated Aug. 25, 2016, 9 pages.
U.S. Office Action on U.S. Appl. No. 14/618,809 dated Aug. 17, 2016.
Notice of Allowance on U.S. Appl. No. 14/618,809 dated Dec. 22, 2016.
U.S. Office Action on U.S. Appl. No. 15/465,385 dated May 18, 2017.
U.S. Office Action on U.S. Appl. No. 15/465,385 dated Sep. 8, 2017.
U.S. Notice of Allowance on U.S. Appl. No. 15/465,385 dated Dec. 8, 2017.

* cited by examiner

SYSTEMS AND METHODS FOR ADDING A TRAINABLE TRANSCEIVER TO A VEHICLE

CROSS-REFERENCE TO RELATED PATENT APPLICATIONS

This application claims the benefit of and priority to U.S. Provisional Application No. 61/938,501, filed Feb. 11, 2014, hereby incorporated by reference in its entirety.

BACKGROUND

The present invention relates generally to the field of trainable transceivers for inclusion within a vehicle. A trainable transceiver generally sends and/or receives wireless signals and may be or include a wireless transceiver. A trainable transceiver may be trained to send a control signal which controls devices (e.g., garage door openers) configured to receive the control signals. Training a trainable transceiver may include providing the trainable transceiver with control information such that a control signal transmitted by the trainable transceiver controls a device associated with the control information. A trainable transceiver may be provided with control information from a control signal sent from an original transmitter (e.g., garage door opener remote) associated with a device (e.g., garage door opener). A trainable transceiver may be incorporated in a vehicle (integrally or contained within the vehicle) and used to control remote devices including garage door openers, lighting systems, gates, etc. Trainable transceivers are generally configured to transmit using radio frequency transmissions over a wide range. Generally, a transceiver configured to transmit over a wide range requires greater power than a transceiver configured to transmit over a short range. A battery powered trainable transceiver for controlling a remote device may therefore be larger than is aesthetically pleasing to transmit over a sufficient distance and last for a sufficient amount of time. It is challenging and difficult to develop trainable transceivers that can operate in a user friendly manner with a variety of vehicles and/or garage door receiver systems.

SUMMARY

One embodiment relates to a trainable transceiver base station for controlling a remote device includes a first transceiver circuit, a power connection, and a control circuit. The first transceiver circuit is configured to transmit activation signals to the remote device, the activation signals formatted based on training information and formatted to control the remote device. The power connection is configured to receive electrical power from a vehicle. The control circuit is configured to cause the first transceiver circuit to transmit the activation signal when a command signal is received at the trainable transceiver base station. The trainable transceiver base station is located at a first location within the vehicle, and the trainable transceiver base station is configured to receive the command signal from a remote button module located at a second location within the vehicle.

Another embodiment relates to a remote button module for controlling a remote device including a user input device, a transceiver, and a control circuit. The control circuit is configured to transmit command signals to a trainable transceiver base station in response to receiving an input at the user input device. The command signal is formatted by the control circuit to cause the trainable transceiver base station to transmit an activation signal to the remote device corresponding to the input, the remote button module is located at a first location within the vehicle with the trainable transceiver base station located at a second location within the vehicle.

Another embodiment relates to a method of pairing a remote button module with a trainable transceiver base station for controlling a remote device. The method includes establishing communication between the remote button module and the trainable transceiver base station, and executing a process of pairing the remote button module to the trainable transceiver base station, including exchanging pairing information. Once paired, the remote button module is configured to transmit a command signal to the trainable transceiver base station in response to a user input, and the trainable transceiver base station is configured to transmit an activation signal formatted to control the remote device in response to receiving the command signal.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
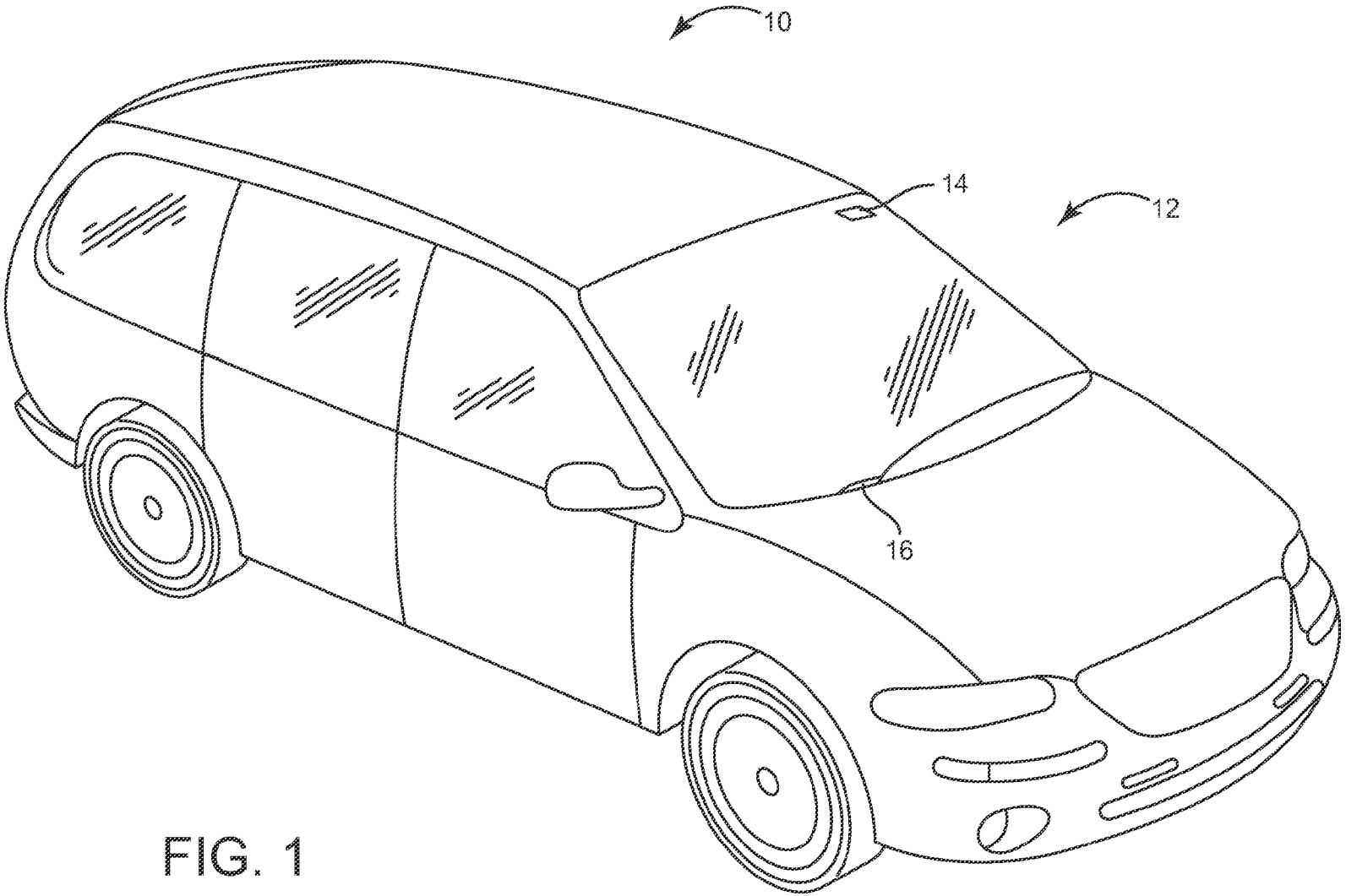
FIG. 1 illustrates an embodiment of a distributed remote system within a vehicle.

Generally, a system for adding a trainable transceiver to a vehicle may operate as a distributed remote system according to the invention includes two components. The first component is a small wireless remote user interface module (e.g., remote button module). The remote button module may be configured to operate with low power consumption. The remote button module wirelessly connects to the second component. The remote button module may send data and/or receive data from the second component. The second component is a base station. The base station may include a trainable transceiver (e.g., trainable transceiver base station). A trainable transceiver is a transceiver which may be configured to send control signals and/or other information to a remote device. The trainable transceiver may be trained by a user to work with particular remote devices and/or home electronic devices (e.g., a garage door opener). For example, a user may manually input control information into the trainable transceiver to configure the trainable transceiver to control the device. A trainable transceiver may also learn control information from an original transmitter. A trainable transceiver may receive a signal containing control information from an original transmitter (e.g., a remote sold with a home electronic device) and determine control information from the received signal. The base station receives data and/or control signals from the remote button module. The base station then transmits the data and/or control signals to a third device. For example, the remote button module may send a control instruction to the base station for activating a garage door opener. The base station may be a HomeLink branded system or trainable transceiver. The base station then transmits a control signal (e.g., to activate the garage door opener) to a wirelessly controlled device (e.g., a garage door opener). The distributed remote system may be added to an existing vehicle by a user and trained to operate a remote device such as a garage door opener.

This distributed remote configuration has an advantage of allowing the remote button module and corresponding hardware components to be packaged in a small housing. The longer range transmitter for communicating with wirelessly controlled devices (e.g., garage door openers) consumes more power than the wireless communication hardware, allowing for communication between the remote button module and the base station. By separating the long range transmitter from the control button, the remote button module may have a small form factor and run on a smaller battery or other power source than if the long range transmitter were included within the same package as the control button. The small and aesthetically pleasing package allows for the remote button module to be mounted in various locations in a vehicle. The distributed remote system also has an advantage of allowing a user to separate an actuation device (e.g., the remote button module) from the transceiver (e.g., the base station). This may facilitate training of the trainable transceiver as discussed herein. A user may also activate the base station and cause it to send a control signal without having physical access to the base station. For example, a user may carry the remote button module on their person and activate a controlled device (e.g., a garage door opener) via the base station by pressing a button on the remote button module. A user may send a control signal from a transceiver without having physical access to the transceiver. The present invention has an additional advantage of allowing removal of the base station from a vehicle to prevent theft of the base station. Additionally, remote buttons and/or base stations may be moved from one vehicle to another, swapped between vehicles, or replaced as a result of the portable nature of the distributed remote system.

FIG. 1 illustrates an embodiment of the distributed remote system 12 within a vehicle 10. The remote button module 14 may be placed, permanently attached, semi-permanently attached, removably attached, or otherwise located within the vehicle 10. In some embodiments, the distributed remote system 12 is added to an existing vehicle. For example, the base station 16 may be inserted into an existing 12 volt power port and the remote button attached to a windshield using adhesive. The distributed remote system 12 may be added to an existing vehicle as a retrofit. For example, the distributed remote system 12 may be added to an existing vehicle that does not have a HomeLink system already installed (e.g., from the factory). The remote button module 14 and base station 16 may be sold as an aftermarket kit. A user may add the distributed remote system 12 to a vehicle. In some embodiments, the distributed remote system 12 may be added to a vehicle without requiring the replacement and/or removal or a vehicle panel. The addition of the distributed remote system 12 may not require a user to perform any modifications to a vehicle wiring system. For example, a user may plug the base station 16 into an existing power port (e.g., 12 volt power port) and attach the remote button module 14 to the windshield of the vehicle 10. Attaching the remote button module 14 to the vehicle 10 may not require the removal, modification, and/or replacement of a vehicle panel. For example, the remote button module 14 may be attached to the windshield of the vehicle 10 as illustrated in FIG. 1. The remote button module 14 may be attached or otherwise located at various positions within the vehicle 10. For example, the remote button module 14 may be attached to a side window, steering wheel, steering column, dashboard, center counsel, head liner, visor, center stack, seat, etc. In some embodiments, the remote button module 14 may include a custom bezel that mimics the style of a specific vehicle interior. In other embodiments, the remote button module 14 may be configured to allow for a bezel to attach to the remote button module 14. For example, the bezel may snap over the remote button module 14, attach to a slot and/or groove of the remote button module 14, etc.

In some embodiments, the remote button module 14 is attached to a location within the vehicle 10 using one or more of a pressure-sensitive adhesive, adhesive, glue, Velcro, foam tape, double sided tape, a magnet included within the remote button module 14 (or a carrier thereof), magnetic tape, etc. In other embodiments, the remote button module 14 is attached to a carrier as discussed herein. For example, the remote button module 14 may snap into the carrier or slide into a grove or slot of the carrier. The carrier may secure the remote button module 14. In some embodiments, the carrier is attached to a surface of the vehicle with adhesive. In other embodiments, one or more of the above described attachment techniques and/or materials with reference to the remote button module 14 are used to secure the carrier.

With continued reference to FIG. 1, the trainable transceiver base station 16 may be placed, permanently attached, semi-permanently attached, removably attached, or otherwise located within the vehicle 10. The base station 16 may be added to a vehicle by a user to retrofit the vehicle. This may add HomeLink capabilities to a vehicle without a HomeLink system already installed. The base station 16 may be part of an aftermarket kit. In some embodiments, the base station 16 may added to a vehicle without requiring the removal of and/or replacement of a vehicle panel. The base station 16 may be added without requiring a user to modify the wiring of the vehicle. For example, the base station 16 may be plugged into an existing 12 volt power port included with the vehicle. In some embodiments, the base station 16 is configured to attach to and be partially, or wholly inserted into a 12 volt power port or cigarette lighter of a vehicle. For example, the base station 16 may be plugged into and supported by a 12 volt power port located in the center stack of the vehicle 10 as illustrated in FIG. 1. The 12 volt power port may be a constant on power source such as a console counted power source and/or an automatic power off (APO) power source. An APO power source may prevent a vehicle battery from being depleted by the base station 16. A constant on and/or APO power source may have a voltage other than 12 volts. In some embodiments, the base station 16 connects to center stack ignition on only power source which provides power to the base station 16 only when the ignition of the vehicle is on. In other embodiments, the base station 16 may be configured to attach to one or more of a Universal Serial Bus (USB) port (e.g., standard A, standard B, mini, micro, etc.). In further embodiments, the base station 16 is configured to attach to varying other types of power outlets. In still further embodiments, the base station 16 is powered by a local rechargeable battery and may be located anywhere within, on, or otherwise connected with the vehicle. In additional embodiments, the base station 16 is wired directly to one or more systems of the vehicle (e.g., power system).

Figure 2A:
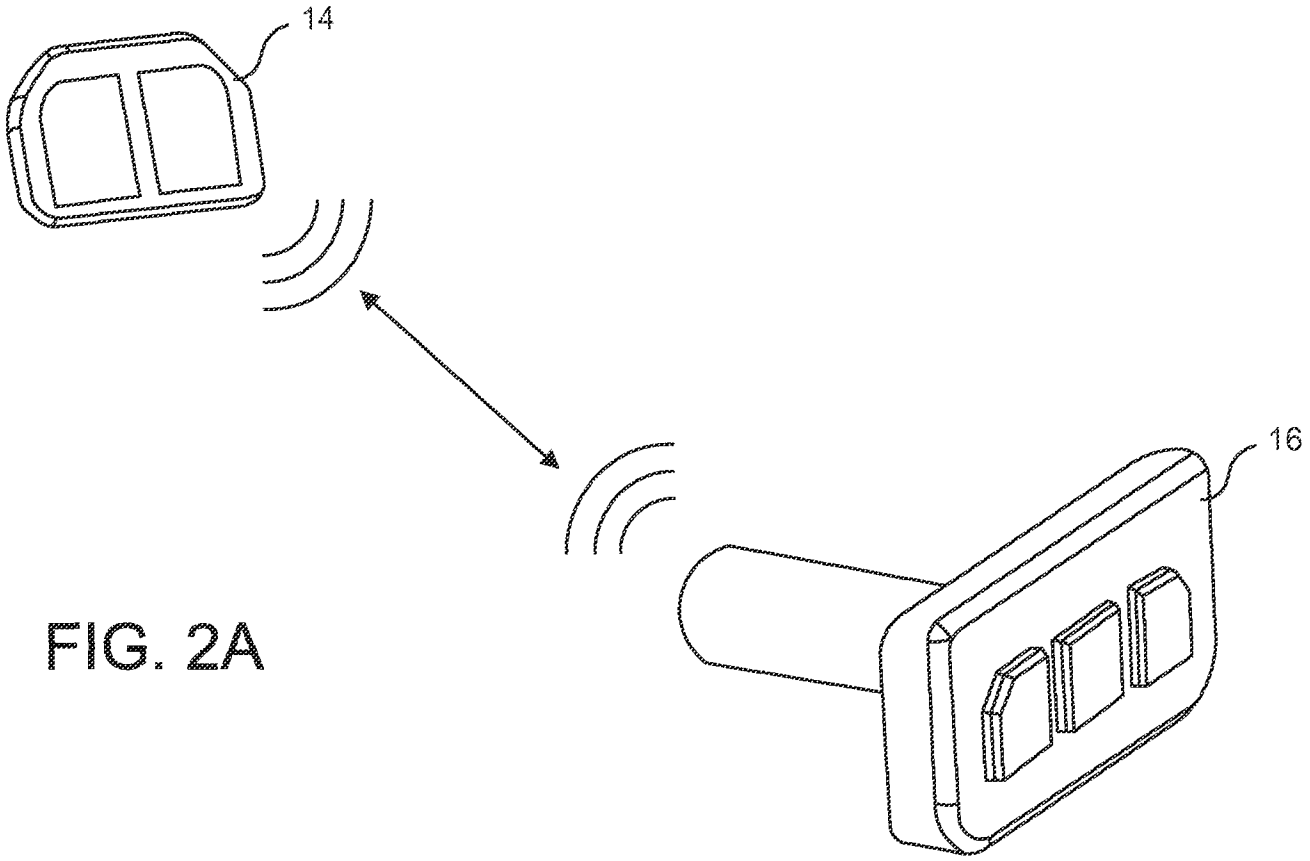
FIG. 2A illustrates an exemplary embodiment of the distributed remote system with a remote user interface module in communication with a trainable transceiver base station.

FIG. 2A illustrates an exemplary embodiment of the distributed remote system 12 with the remote button module 14 in communication with the base station 16. The remote user interface module and base station 16 may communication with a variety of wireless communications techniques. In one embodiment, the remote button module 14 and base station 16 communicate using radio frequency transmissions. The remote button module 14 and base station 16 can communicate using one or more Industrial, Scientific, and Medical (ISM) bands (e.g., the band at 2.4 GHz) using one or more Bluetooth protocols (e.g., v2.0, v3.0, v4.0, etc.). In other embodiments, the remote button module 14 and base station 16 communicate using other radio frequencies. In further embodiments, the remote button module 14 and base station 16 may communication using one or more of infrared transmissions, optical transmissions, or other wireless digital or analog transmission medium. Wireless communication of the type just described may be carried out using hardware components including a circuit having a Bluetooth transceiver chip and a microprocessor, a Bluetooth System on a Chip (SoC), Bluetooth Low Energy (BLE) SoC, a transmitter or transmitters, a receiver or receivers, a transceiver or transceivers, of another communication system architecture.

In some embodiments, the communication between the remote button module 14 and the base station 16 is encrypted or otherwise secured. In one embodiment, the remote button module 14 and base station 16 communicate using an Advanced Encryption Standard (AES). Certain embodiments may utilize encryption techniques and/or standards such as ISO/IEC 18033-3, AES 128 bit encryption, a rolling code, a hopping code, fixed code, KeeLoq, or other security or encryption techniques.

In further embodiments, the distributed remote system 12 includes additional security features. In one embodiment, the remote button module 14 includes a finger print scanner/reader. A user may be prevented from using the remote button module 14 if the scanned/read fingerprint does not match a corresponding print stored in the memory of the remote button module 14. The base station 16 may also include a fingerprint scanner/reader in addition to or in place of a fingerprint scanner/reader in the remote button module 14. In other embodiments, the distributed remote system 12 uses two-step verification (e.g., multi-factor authentication). This may require a user to have another device (e.g., a mobile computing device such as a laptop or mobile phone) connected to the distributed remote system 12 (e.g., one or more of the remote button module 14 and base station 16).

Figure 2B:
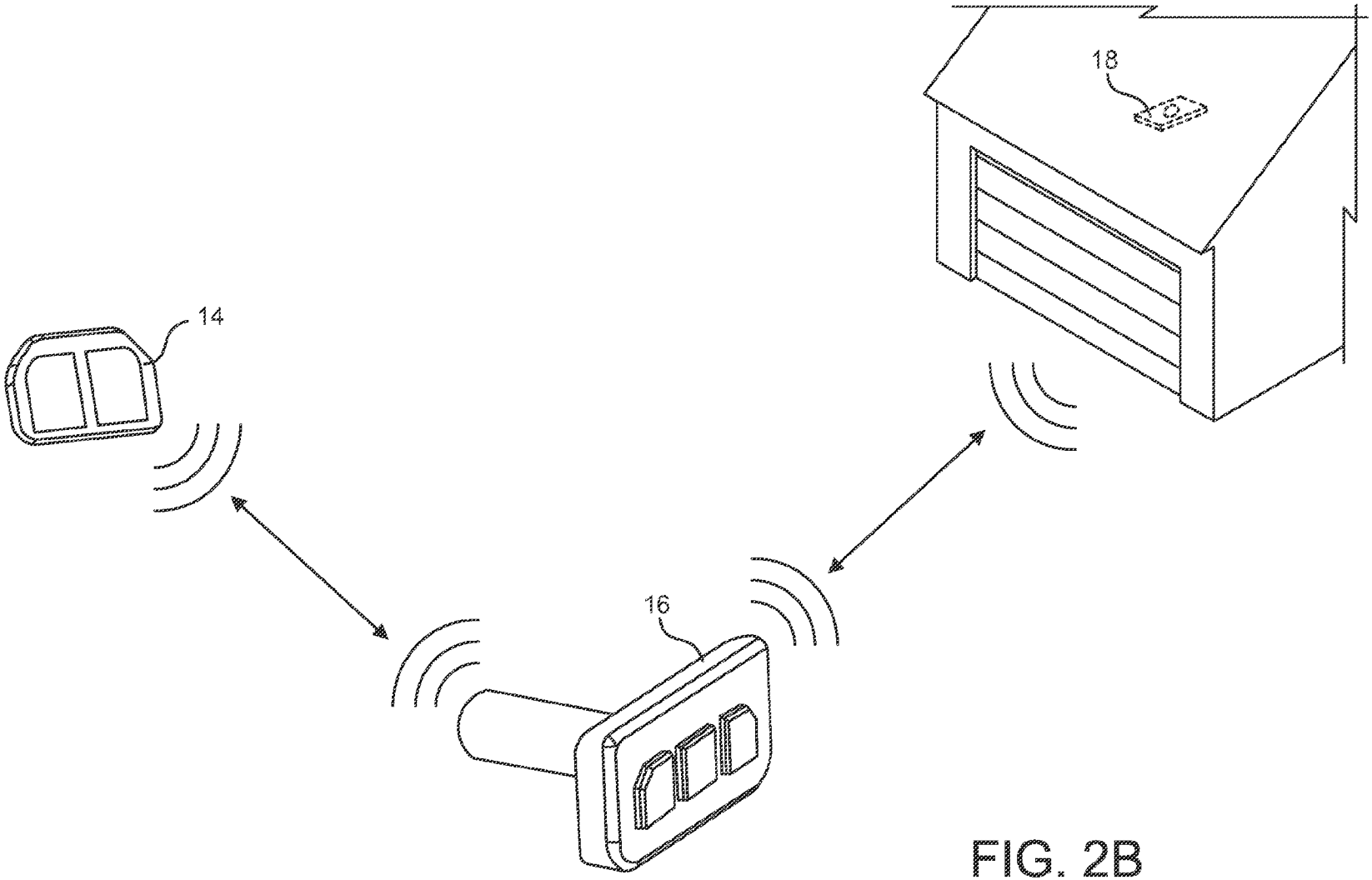
FIG. 2B illustrates as exemplary embodiment of the distributed remote system, including a remote button module and base station, in communication with an additional device.

FIG. 2B illustrates as exemplary embodiment of the distributed remote system 12 in communication with an additional device 18. The additional device 18 may be a home electronic device and/or remote device. The home electronic device may be a garage door opener as illustrated in FIG. 2B. In one embodiment, the distributed remote system 12 communicates with the additional device 18 (e.g., home electronic device) using a transmitter, receiver, and/or transceiver located in the base station 16. In some embodiments the base station 16 and the additional device 18 (e.g., a home electronic device or remote device such as a garage door opener) communicate using frequencies in the ultra-high frequency range, typically between 260 and 960 megahertz (MHz) although other frequencies may be used.

The base station 16 of the distributed remote system 12 may communicate wirelessly with additional devices 18. One or more of the communications techniques and/or devices described above with reference to FIG. 2A may be used. For example, the base station 16 may include a radio frequency transceiver to transmit and/or receive radio frequency transmissions related to the garage door opener. In some embodiments, the base station 16 of the distributed remote system 12 communicates with additional devices 18 using encryption techniques. One or more of the encryption techniques described above with reference to FIG. 2A may be used. For example, the base station 16 may communicate with the garage door opener using a rolling code or fixed code. In other embodiments, the remote button module 14 may use different communication and/or encryption techniques. For example, the remote button module 14 may communicate with the base station 16 using a Bluetooth protocol and the base station 16 may communicate with a home electronic device (e.g., a garage door opener) using a radio frequency transmitter and a rolling code.

In other embodiments, the remote user interface module may communicate directly with additional devices using one or more of the techniques and or components described herein. For example, the remote user interface module (e.g., remote button module 14) may communicate directly with a garage door opener using a radio frequency transceiver.

Figure 3:
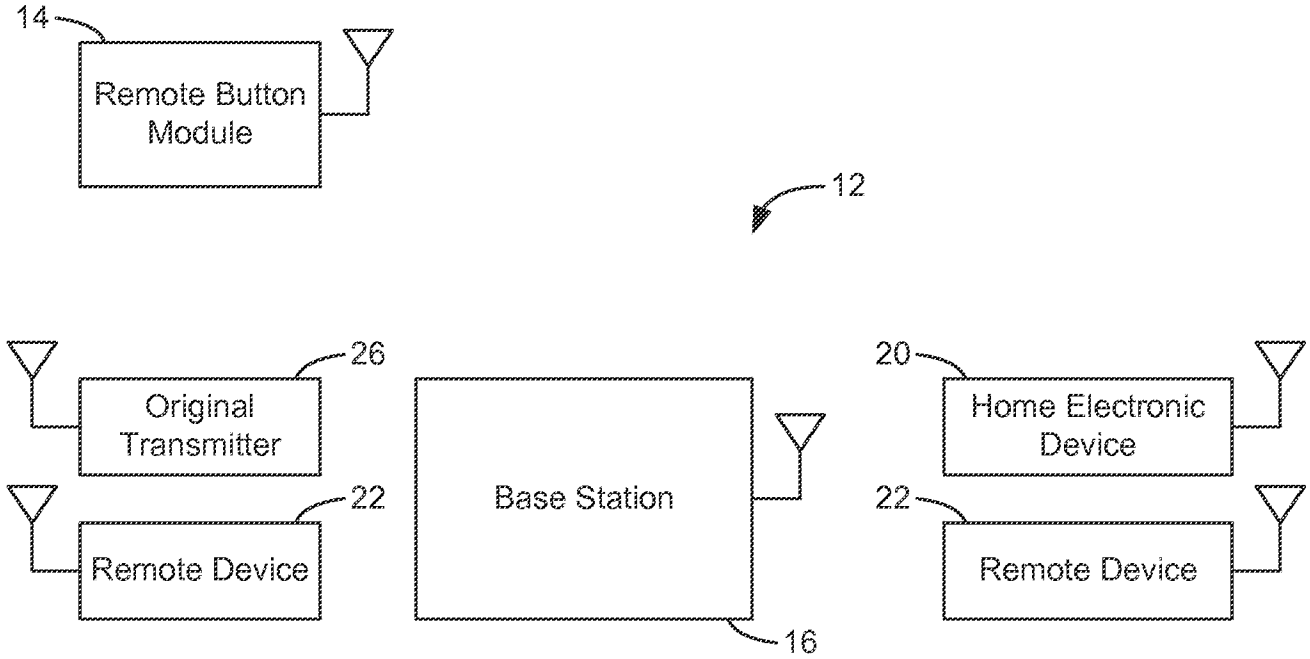
FIG. 3 illustrates a base station in communication with home electronic devices, remote devices, original transmitters, and/or one or more remote button modules according to an exemplary embodiment.

Referring now to FIG. 3, in an exemplary embodiment, the base station 16 transmits a control signal to a home electronic device 20 and/or remote device 22. For example, the base station 16 may transmit a control signal to a garage door opener. The trainable transceiver base station 16 may be in communication with (e.g., send and receive transmissions, data, control instructions, control signals, etc.) with home electronic devices 20, remote devices 22, original transmitters 26, and/or one or more remote button modules 14. The base station 16 may transmit a control signal to an additional device. The additional device may be a home electronic device and/or a remote device. The remote button module 14 may transmit a triggering signal to the base station 16. This may affect the base station 16 to transmit the control signal to the additional device. In some embodiments, a second button on the remote button module 14 may affect the remote button module 14 to send a different triggering signal to the base station 16. The different triggering signal may affect the base station 16 to send a control signal to a different home electronic device 20 and/or remote device 22. For example, the first button on the remote button module 14 may affect the base station 16 to send a control signal to a garage door opener while the second button on the remote button module 14 may affect the base station 16 to send a control signal to a home lighting system. Home electronic devices 20 may be any device configured to send and/or receive wireless transmissions and located within, attached to, or near a home. For example, home electronic device 20 may include a garage door opener, media controller, media devices (e.g., radio, television, etc.), lighting controller, light fixtures, irrigation system, outdoor lights, electrical sockets, kitchen appliances, personal computers, home networking devices, etc. Remote devices 22 may be any portable device configured to send and/or receive wireless transmissions. For example, remote devices may include portable telephones, smart phones, tablets, laptop computers, personal digital assistants, vehicles, or other devices not physically connected such that they are not readily movable. Remote devices 22 may include portable devices.

The base station 16 may also be in communication with an original transmitter 26. An original transmitter 26 is a remote that is intended to work with a home electronics device 20 or remote device 22. For example, an original transmitter 26 may include a remote which is provided with a home electronics device 20 or remote device 22 (e.g., packaged with a product at the point of purchase by a consumer). Original transmitters 26 may alternatively be remotes which are user programmed to communicate with home electronic devices 20 or remote devices 22. For example, an original transmitter 26 may be a universal remote programmed or trained by a user to communicate with a home electronic device 20 or remote device 22. In one embodiment, the base station 16 is trained using the communication between the base station 16 and the original transmitter 26. For example, a trainable transceiver base station 16 (e.g., a HomeLink branded system) may learn control information for sending a control signal from a transmission received from an original transmitter 26.

In some embodiments, the remote button module 14 is configured for communication only with one or more base stations 16. In other embodiments, the remote button module 14 may communicate with an original transmitter 26. For example, the remote button module 14 may be in communication with an original transmitter 26 for the purposes of training the distributed remote system 12. In further embodiments, the remote button module 14 may be in communication with a remote device 22. For example, the remote button module 14 may send to and/or receive data from a smart phone. This may facilitate training of the distributed remote system 12, be used to implement security procedures (e.g., two-step identification), send a control signal to another device using the remote device, display and/or transfer application data or other data, etc. In other embodiments, the remote button module 14 may also communicate, at times with one or more home electronic device 20 and/or remote device 22. For example, the remote button module 14 may communicate with a home electronic device 20 and/or remote device 22 during training of the distributed remote system 12.

In one embodiment, during normal operation (e.g., post-training, post-pairing, post-setup, or when the base station 16 is otherwise ready to send a control signal to a remote device 22 and/or home electronic device 20) the base station 16 receives an input from the remote button module 14. The input may be data, a command instruction to relay to another device, and/or other information. The remote button module 14 may send the base station 16 an input to operate another device by sending a command instruction. For example, when a button on the remote button module 14 is pushed it may result in the remote button module 14 sending an input to the base station 16 using BLE. In response to the input, the base station 16 sends a command instruction to a third device using a transceiver and the appropriate communication protocol. Sending a command instruction may include the base station 16 determining the proper protocol and or transmission frequency, applying security protocols (e.g., checking a rolling code data set stored in memory), or the base station 16 otherwise formatting the control signal. Continuing the example, the input sent by the button to the base station 16 may provide information to the base station 16 that a button has been pushed on the remote button module 14. The base station 16 may process this input and determine that the input corresponds to sending a command instruction to raise or lower a garage door by activating a garage door opener. The base station 16 then selects the proper transmission characteristics (e.g., applying the rolling code security protocol associated with the device to be controlled, the frequency, etc.) and generates a command instruction. The command instruction may be for the garage door opener to turn on. The instruction is then sent to the garage door opener.

In other embodiments, the remote button module 14 may perform additional tasks (e.g., selecting and/or applying a security protocol for the device to be controlled). The remote button module 14 may send a command instruction to the base station 16. The base station 16 may then use the onboard transceiver, which may have greater power and/or range, to forward the command instruction to the device to be controlled. For example, the remote button module 14 generates a command instruction for a garage door opener to be activated. The command instruction is then transmitted to the base station 16. The base station 16 receives the command instruction and repeats it (e.g., with or without further encryption or other transformation) by transmitting it at greater power and/or range to the garage door opener. Advantageously, this may provide the remote control system greater range than if the remote button module 14 was used alone to control home electronic devices and/or remote devices. In some embodiments, the base station 16 may also include more memory allowing for the storage of a greater amount of information such as control information, encryption codes, pairing information, identification information, a device registry, data from a home electronic device 20 and/or remote device 22, applications and/or application data, programs, and/or other data related to devices and functions described herein. The remote system may therefore provide an advantage by including more data storage capacity than if a single device or just a remote button module 14 were used. Storing additional device and/or communications information may also allow for the system to be compatible with more home electronic devices 20, remote devices 22, and/or original transmitters 26.

Figure 4A:
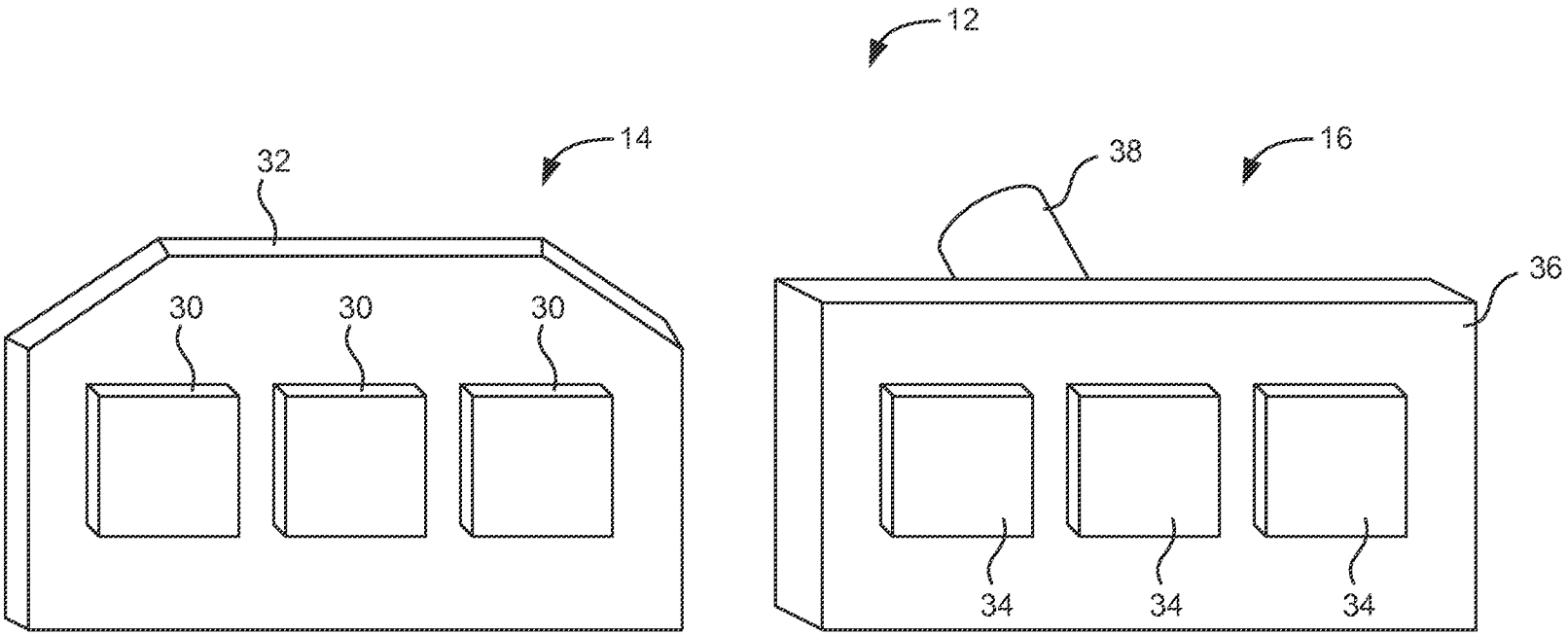
FIG. 4A illustrates a remote button module and a trainable transceiver base station according to one embodiment.

FIG. 4A illustrates a remote user interface module and a base station 16 according to one embodiment. The remote button module 14 may have a chamfered rectangular shape. The remote button module 14 may include three buttons 30 for receiving user input. In some embodiments, the buttons 30 are hard key buttons. In other embodiments, the buttons 30 are soft keys (e.g., capacitive touch buttons or resistive touch buttons). In other embodiments, the remote button module 14 may include other numbers of buttons 30. For example, the remote button module 14 may include one button 30, two buttons 30, three buttons 30, etc. In one embodiment, the remote button module 14 has a thin profile. For example, the remote button module 14 may have a width of between five and seven millimeters. In some embodiments, the buttons 30 on the remote button module 14 may be flush with the housing 32 of the remote button module 14. This may provide an integrated appearance. In other embodiments, the buttons 30 may extend from the housing 32 of the remote button module 14.

The trainable transceiver base station 16 may include three buttons 34 to receive user input. The buttons 34 may be configured as described above with reference to the remote button 34 module 14. This provides an advantage to a user in that the user may send a control signal to a home electronic device and/or remote device by pressing a button 34 on either the base station 16 or the remote button 34 module 14. For example, a user which has forgotten the remote button 34 module 14 may still control a remote device and/or home electronic device using the input devices included in the base station 16. In some embodiments, the base station housing 36 has a rectangular shape as illustrated in FIG. 4A. In other embodiments, the base station housing 36 has other shapes such as rectangles of various dimensions, hemispheres, spheres, cubes or various dimensions, geometric shapes, a combination of some or all of the preceding, or other appearance. The base station 16 may include a connection 38 compatible with a 12 volt power port (e.g., cigarette lighter). The connection 38 may provide support for the base station 16 and/or form an electrical connection with the vehicle. In some embodiments, the connection 38 is configured such that the base station 16 is flush with a vehicle surface upon connection with the 12 volt power port. In other embodiments, the connection 38 may extend out of the 12 volt power port when connected. In further embodiments, the connection 38 may include features such as extenders, hinges, locks, etc. which allow a user to reposition the housing 36 of the base station 16 relative to the 12 volt power port which the base station 16 is connected to the 12 volt power port.

Figure 4B:
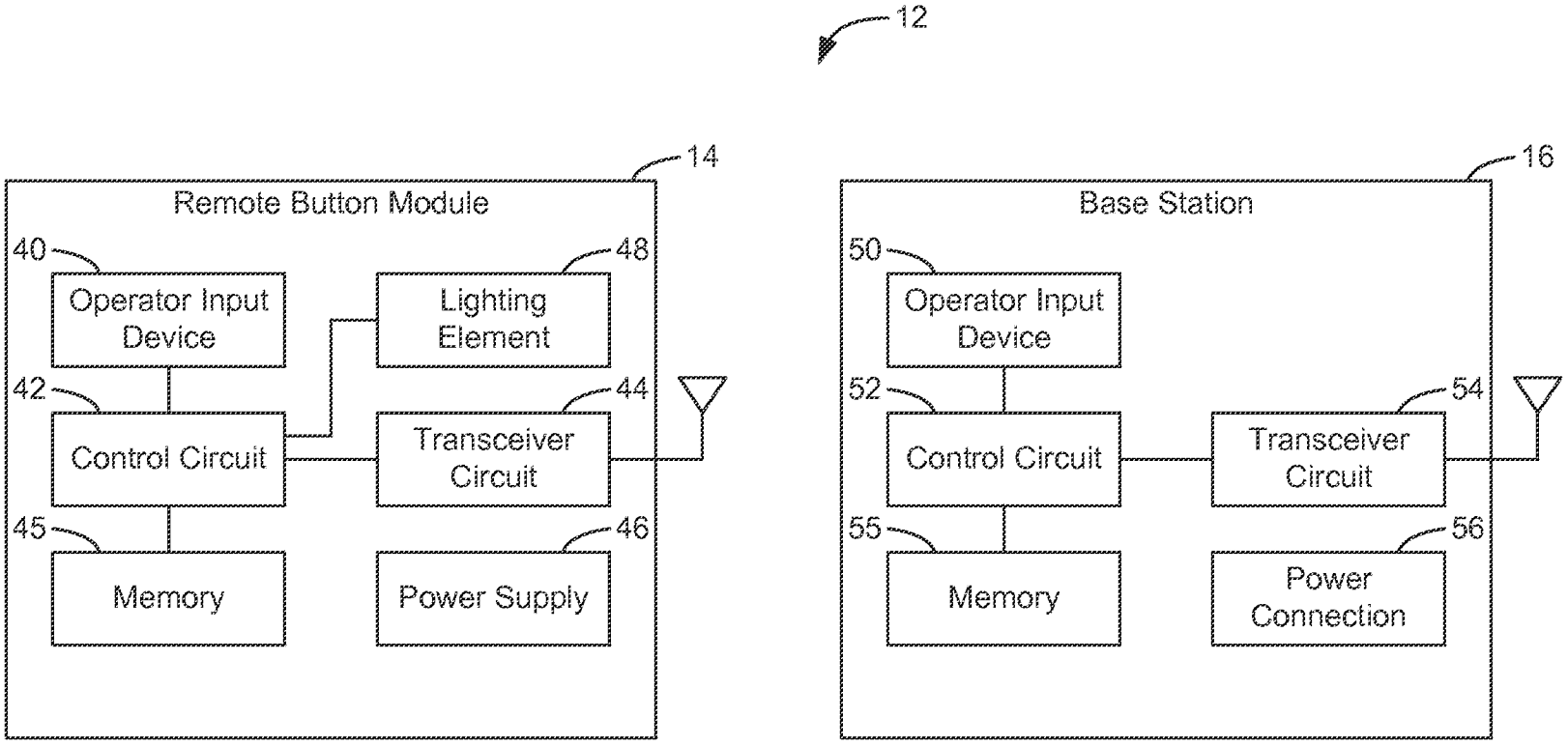
FIG. 4B illustrates one embodiment of hardware components included in the remote user interface module and the base station which correspond to the embodiment illustrated in FIG. 4A.

FIG. 4B illustrates one embodiment of hardware components included in the remote button module 14 and the base station 16 which correspond to the embodiment illustrated in FIG. 4A. In one embodiment, the remote button module 14 includes an operator input device 40. The operator input device 40 may be one or more buttons as illustrated in FIG. 4A. In some embodiments, the operator input device 40 may include input devices such as touchscreen displays, switches, microphones, knobs, touch sensor (e.g., projected capacitance sensor resistance based touch sensor, resistive touch sensor, or other touch sensor), proximity sensors (e.g., projected capacitance, infrared, ultrasound, infrared, or other proximity sensor), or other hardware configured to generate an input from a user action. In additional embodiments, the operator input device 40 may display data to a user or other provide outputs. For example, the operator input device 40 may include a display screen (e.g., a display as part of a touchscreen, liquid crystal display, e-ink display, plasma display, light emitting diode (LED) display, or other display device), speaker, haptic feedback device (e.g., vibration motor), LEDs, or other hardware component for providing an output. In some embodiments, the operator input device 40 is connected to the control circuit 42. The control circuit 42 may send information and or control signals or instructions to the operator input device 40. The control circuit 42 may also receive input signals, instructions, and/or data from the operator input device 40.

The control circuit 42 may include various types of control circuitry, digital and/or analog, and may include a microprocessor, microcontroller, application-specific integrated circuit (ASIC), or other circuitry configured to perform various input/output, control, analysis, and other functions to be described herein. In other embodiments, the control circuit 42 may be a SoC individually or with additional hardware components described herein. The control circuit 42 may further include, in some embodiments, memory (e.g., random access memory, read only memory, flash memory, hard disk storage, flash memory storage, solid state drive memory, etc.). In further embodiments, the control circuit 42 may function as a controller for one or more hardware components included in the remote button module 14. For example, the control circuit 42 may function as a controller for a touchscreen display or other operator input device 40, a controller for a transceiver, transmitter, receiver, or other communication device (e.g., implement a Bluetooth communications protocol).

In some embodiments, the control circuit 42 receives inputs from operator input devices 40 and processes the inputs. The inputs may be converted into control signals, data, inputs to be sent to the base station 16, etc. The control circuit 42 controls the transceiver circuit 44 and uses the transceiver circuit 44 to communicate with the base station 16. The control circuit 42 may also be used to pair the remote user interface module with the trainable transceiver base station 16.

The control circuit 42 is coupled to memory 45. The memory 45 may be used to facilitate the functions of the remote button module 14 and/or distributed remote system 12 described herein. Memory 45 may be volatile and/or non-volatile memory 45. For example, memory 45 may be random access memory, read only memory, flash memory, hard disk storage, flash memory storage, solid state drive memory, etc. In some embodiments, the control circuit 42 reads and writes to memory 45. Memory 45 may include computer code modules, data, computer instructions, or other information which may be executed by the control circuit 42 or otherwise facilitate the functions of the remote button module 14 and/or distributed remote system 12 described herein. For example, memory 45 may include encryption codes, pairing information, identification information, a device registry, etc.

The remote button module 14 may further include a transceiver coupled to the control circuit 42. The transceiver allows the remote button module 14 to transmit and/or receive wireless communication signals. The wireless communication signals may be transmitted to or received from a variety of wireless devices as described with reference to FIG. 3. In one embodiment, the transceiver allows the remote button module 14 to communicate with the base station 16. For example, the transceiver may receive information such as pairing information (e.g., pairing requests from a base station 16, pairing encryption information, etc.), status information regarding the base station 16 and/or a device controlled by or in communication with the base station 16 (e.g., whether a garage door is open or closed), etc. The transceiver may also send information, instructions, inputs, control signals, etc. to the base station 16. For example, the remote user interface module may send the base station 16 an input corresponding to an operator input device 40 being actuated by a user, information about the power remaining in a battery of the remote button module 14, a control signal (e.g., close a garage door or turn on a garage door opener), etc. The transceiver may be controlled by the control circuit 42. For example, the control circuit 42 may turn on or off the transceiver (e.g., when the remote button module 14 is not paired with a base station 16 and a pairing sequence has not been initiated, the control circuit 42 may disable the transceiver), the control circuit 42 may send data using the transceiver, etc. Inputs from the transceiver may also be received by the control circuit 42. In some embodiments, the transceiver may include additional hardware such as processors, memory 45, integrated circuits, antennas, etc. The transceiver may process information prior to transmission or upon reception and prior to passing the information to the control circuit 42. In some embodiments, the transceiver may be coupled directly to memory 45 (e.g., to store encryption data, retrieve encryption data, etc.). In further embodiments, the transceiver may include one or more transceivers, transmitters, receivers, etc. For example, the transceiver may include an optical transceiver, near field communication (NFC) transceiver, etc. for pairing with a base station 16 and a BLE transceiver for communicating with a paired base station 16 or other device. In some embodiments, the transceiver may be implemented as a SoC.

The remote button module 14 further includes a power source 46. In some embodiments, the power source 46 is or includes a battery. In other embodiments, one or more different power sources 46 may be used in combination. For example, the power source 46 may include one or more of solar cells, capacitors, batteries (e.g., a lithium-ion battery, coin cell battery, etc.), wireless charging mechanism (e.g., inductive charging coils), USB charging port, wired connection to a power supply outside of the remote button module 14 housing, a power source 46 recharged by the movement of the vehicle (e.g., an inductive charging component or an eccentric weight and ratcheted winding mechanism), etc. The power source 46 may be connected to one or more hardware components of the remote button module 14.

In some embodiments, the remote button module 14 further includes one or more lighting elements 48. The lighting element 48 may be connected to and/or controlled by the control circuit 42. In some embodiments, lighting element 48 is one or more light emitting diodes (LEDs). In other embodiments, the lighting element 48 is one or more of LEDs, a backlight, luminescent material, incandescent light source, a display screen or touchscreen, or other light source. In some embodiments, lighting element 48 may be a decorative light. In other embodiments, lighting element 48 may perform a function such as providing light at a predetermined ambient light level, providing information to a user, providing backlighting, locating the remote button module 14, communicating information to the base station 16 or other device, and/or other function described herein.

With continued reference to FIG. 4B, an embodiment of the hardware components of the base station 16 is illustrated. The embodiment of the hardware components illustrated in FIG. 4B corresponds to the embodiment of the trainable transceiver base station 16 illustrated in FIG. 4A. In one embodiment, the base station 16 includes similar or the same components as those discussed with reference at the remote button module 14. In some embodiments, the base station 16 includes an operator input device 50. The operator input device 50 may be one or more buttons as illustrated in FIG. 4A. In some embodiments, the operator input device 50 may include input devices such as touchscreen displays, switches, microphones, knobs, touch sensor (e.g., projected capacitance sensor resistance based touch sensor, etc.), proximity sensors (e.g., projected capacitance, infrared, ultrasound, etc.), etc. In additional embodiments, the operator input device 50 may display data to a user or other provide outputs. For example, the operator input device 50 may include a display screen (e.g., a display as part of a touchscreen, liquid crystal display, e-ink display, plasma display, light emitting diode (LED) display, etc.), speaker, haptic feedback device (e.g., vibration motor), LEDs, etc. In some embodiments, the operator input device 50 is connected to the control circuit 52. The control circuit 52 may send information and or control signals or instructions to the operator input device 50. The control circuit 52 may also receive input signals, instructions, and/or data from the operator input device 50.

The base station 16 further includes control circuitry. The control circuit 52 may include various types of control circuitry, digital and/or analog, and may include a microprocessor, microcontroller, application-specific integrated circuit (ASIC), or other circuitry configured to perform various input/output, control, analysis, and other functions to be described herein. In other embodiments, the control circuit 52 may be a SoC individually or with additional hardware components described herein. The control circuit 52 may further include, in some embodiments, memory (e.g., random access memory, read only memory, flash memory, hard disk storage, flash memory storage, solid state drive memory, etc.). In further embodiments, the control circuit 52 may function as a controller for one or more hardware components included in the remote button module 14. For example, the control circuit 52 may function as a controller for a touchscreen display or other operator input device 50, a controller for a transceiver, transmitter, receiver, or other communication device (e.g., implement a Bluetooth communications protocol).

The base station 16 may further include memory 55. The memory 55 may be used to facilitate the functions of the base station 16 and/or distributed remote system 12 described herein. Memory 55 may be volatile and/or non-volatile memory. For example, memory 55 may be random access memory, read only memory, flash memory, hard disk storage, flash memory storage, solid state drive memory, etc. In some embodiments, the control circuit 52 reads and writes to memory 55. Memory 55 may include computer code modules, data, computer instructions, or other information which may be executed by the control circuit 52 or otherwise facilitate the functions of the remote button module 14 and/or distributed remote system 12 described herein. For example, memory 55 may include encryption codes, pairing information, identification information, a device registry, user preferences, user settings, etc.

The base station 16 may further include a transceiver circuit 54. The transceiver circuit 54 allows the base station 16 to transmit and/or receive wireless communication signals. The wireless communication signals may be transmitted to or received from a variety of wireless devices as described with reference to FIG. 3. In one embodiment, the transceiver circuit 54 allows the base station 16 to communicate with the remote button module 14. For example, the transceiver circuit 54 may receive information such as pairing information (e.g., pairing requests from a remote button module 14, pairing encryption information, etc.), status information regarding the remote button module 14 such as remaining battery life and/or a device connected to the remote button module 14 (e.g., whether a smart phone is connected to the remote button module 14), etc. The transceiver circuit 54 may also send information, instructions, inputs, control signals, etc. to the remote button module 14. For example, the base station 16 may send the remote button module 14 information about a device controlled by or in communication with the base station 16 (e.g., the status of a garage door opener, status of lights, status of gates, etc.), etc. The transceiver circuit 54 may also send signals to devices controlled by or in communication with the base station 16 and/or receive signals from devices controlled by or in communication with the base station 16. For example, the transceiver circuit 54 of the base station 16 may be more powerful and/or have a greater range than the transceiver in the remote button module 14. The base station 16 may be configured to draw power from the vehicle or other source which advantageously allows the base station 16 to consume more power than the remote button module 14 when transmitting to other devices. The signal sent by the transceiver circuit 54 to devices controlled or otherwise in communication with the base station 16 may be encrypted using the transceiver circuit 54 and associated components and/or with additional components of the base station 16 (e.g., the control circuit 52 and memory). The base station 16 may send a control signal and/or data to a home electronic device and/or remote device using the transceiver circuit 54.

The transceiver circuit 54 may be controlled by the control circuit 52. For example, the control circuit 52 may turn on or off the transceiver circuit 54 (e.g., when the base station 16 is not paired with a remote button module 14 and a pairing sequence has not been initiated, the control circuit 52 may disable the transceiver), the control circuit 52 may send data using the transceiver, etc. Inputs from the transceiver circuit 54 may also be received by the control circuit 52. In some embodiments, the transceiver may include additional hardware such as processors, memory, integrated circuits, antennas, etc. The transceiver circuit 54 may process information prior to transmission or upon reception and prior to passing the information to the control circuit 52. In some embodiments, the transceiver circuit 54 may be coupled directly to memory 55 (e.g., to store encryption data, retrieve encryption data, etc.). In further embodiments, the transceiver circuit 54 may include one or more transceivers, transmitters, receivers, etc. For example, the transceiver circuit 54 may include an optical transceiver, near field communication (NFC) transceiver, etc. for pairing with a remote button module 14 and a BTE transceiver for communicating with a paired remote button module 14 or other device. In some embodiments, the transceiver circuit 54 may be implemented as a SoC.

The base station 16 may further include a power connection 56. The power connection 56 may be a connection allowing the base station 16 to be in electrical communication with a 12 volt power port (e.g., cigarette lighter) as illustrated in FIG. 4A. In other embodiments, the power connection 56 is a USB connector allowing the base station 16 to be in electrical communication with a USB port. For example, the power connection 56 may be a USB cable with a male adapter. In some embodiments, the power connection 56 is or includes a battery. In other embodiments, one or more different power sources may be used in combination with or in place of the power connection 56. For example, the power source may include one or more of solar cells, capacitors, batteries (e.g., a lithium-ion battery), wireless charging mechanism (e.g., inductive charging coils), USB charging port, wired connection to a power supply (e.g., direct wiring coupling the base station 16 to a vehicle power supply), a power source recharged by the movement of the vehicle (e.g., an inductive charging component or an eccentric weight and ratcheted winding mechanism), etc. The power supply may be connected to one or more hardware components of the base station 16. Power connection 56 may serve as a power source for base station 16. Power connection 56 may receive power from a power source external or internal to base station 16.

Figure 4C:
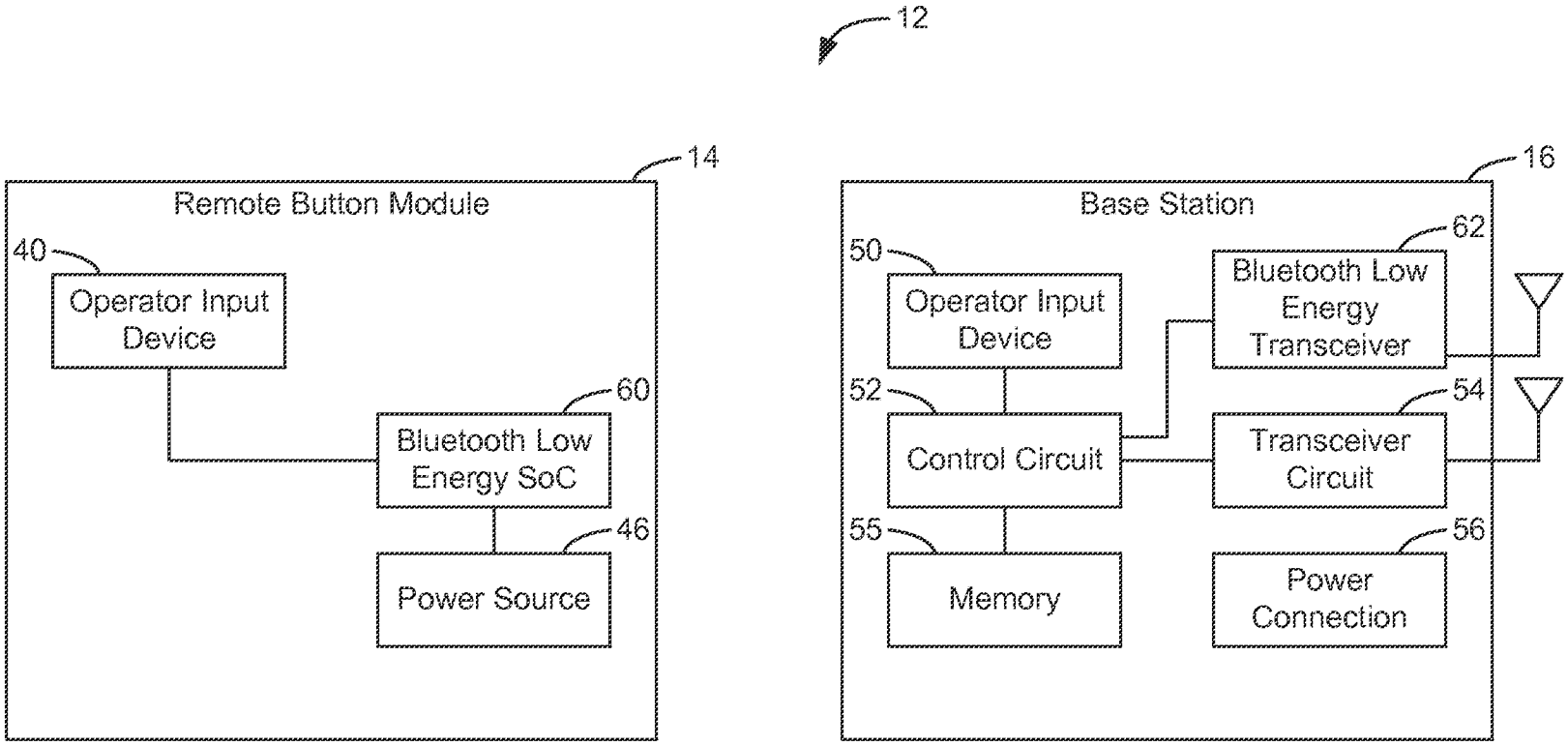
FIG. 4C illustrates an embodiment of the remote button module and the trainable transceiver base station including a Bluetooth low energy system on a chip.

FIG. 4C illustrates an embodiment of the remote button module 14 and the base station 16 including a BLE SoC 60. The remote button module 14 may communication with the base station 16 using the BLE protocol and a BLE SoC 60. In some embodiments, the remote button module 14 and the base station 16 communicate using BLE when in a paired state. The remote button module 14 may include a single SoC implementing the functions of the control circuit and memory discussed above as well as handling inputs from operator input devices 40 and communicating using the BLE protocol. This communication may, as described above, allow the remote button module 14 and the base station 16 to send and receive control signals, inputs, data, and/or other information. The base station 16 includes a BLE transceiver 62 as well in order to allow the base station 16 to communicate with the remote button module 14. The BLE SoC 60, BLE transceiver 62, and BLE protocol may also be used to pair the remote button module 14 and the base station 16. In some embodiments, the BLE SoC 60 may replace the transceiver circuit 44 of the remote button module 14 as illustrated in FIG. 4B. In other embodiments, the BLE SoC 60 may supplement the transceiver 44. In some embodiments, the BLE SoC 60 may replace the transceiver circuit 54 of the base station 16. In such a case, the base station 16 may communicate, using the BLE protocol, with home electronic devices and/or remote devices. In other embodiments, the base station 16 includes both a BLE transceiver 62 and a transceiver circuit 54. In such a case, the base station 16 communicates with the remote button module 14 using the BLE protocol and BLE transceiver 60. The base station 16 may communicate with home electronic devices and/or remote devices using a transceiver circuit 54. The base station 16 may have one antenna coupled to the BLE transceiver 62 and a second antenna coupled to the transceiver circuit 54. Advantageously, this allows the remote button module 14 to communicate with the base station 16 using a low energy protocol to conserve electrical power and reduce the size of the battery needed to support the functions of the remote button module 14. Additionally, the range of the base station 16 is not reduced because it uses the transceiver circuit 54 (e.g., a transceiver broadcasting with greater power and/or range) to communicate with home electronic devices and/or remote devices. In both the remote button module 14 and the base station 16, the BLE SoC 60 may be controlled entirely or in part by the control circuit to which it is coupled. In some embodiments, the first antenna and or the second antenna are one or more of a flexible antenna, hinged antenna, wire antenna, part of the frame of the base station 16 or remote button module 14, loop antenna, or other antenna structure or type.

Figure 4D:
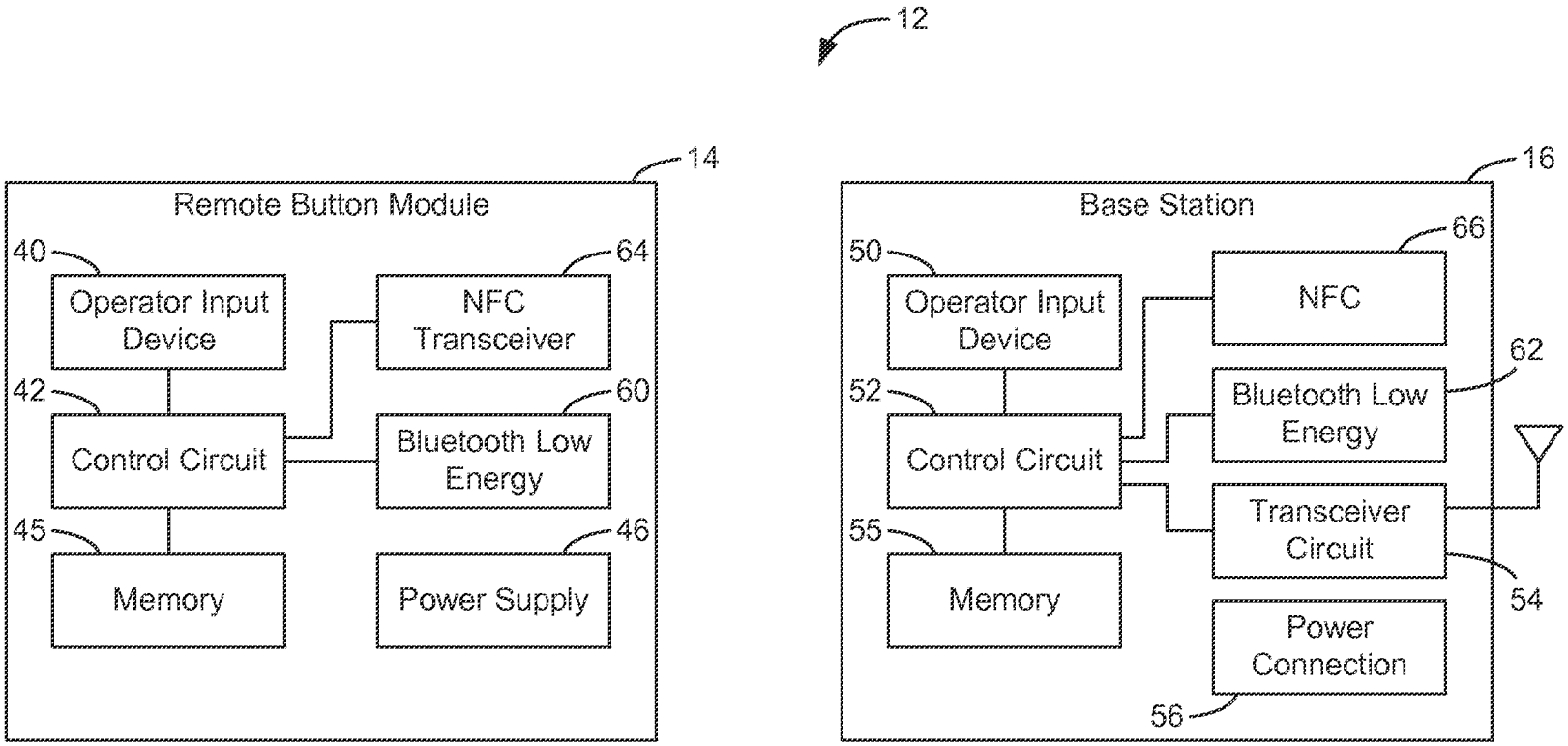
FIG. 4D illustrates and embodiment of the remote button module and the base station including a near field communications system on a chip.

FIG. 4D illustrates and embodiment of the remote button module 14 further including a NFC communications device. The NFC communications device may be an NFC transceiver 64 coupled to the control circuit 42. In other embodiments, the NFC communications device is or forms part of a SoC. The base station 16 may include an NFC transceiver 66. This embodiment retains the advantages discussed with respect to FIG. 4C. Additionally, the remote button module 14 and the base station 16 may communicate using NFC transceivers 64 and 66 and a NFC protocol. For example, the remote button module 14 and the base station 16 may pair using a NFC protocol. In some embodiments, this eliminates the need to exchange pairing passwords while allowing a secured (e.g., encrypted) connection to be established between the remote button module 14 and the base station 16. This may advantageously simplify the pairing process by simply requiring that the remote button module 14 and the base station 16 be in close proximity. Furthermore, the requirement of close proximity (e.g., within the range of the NFC transceivers 64 and 66) may add to the security of the distributed remote system 12. In further embodiments, additional steps may be required to pair the remote button module 14 and the base station 16. For example, an input may be required on the remote button module 14 and/or the base station 16 in order to complete pairing.

Figure 4E:
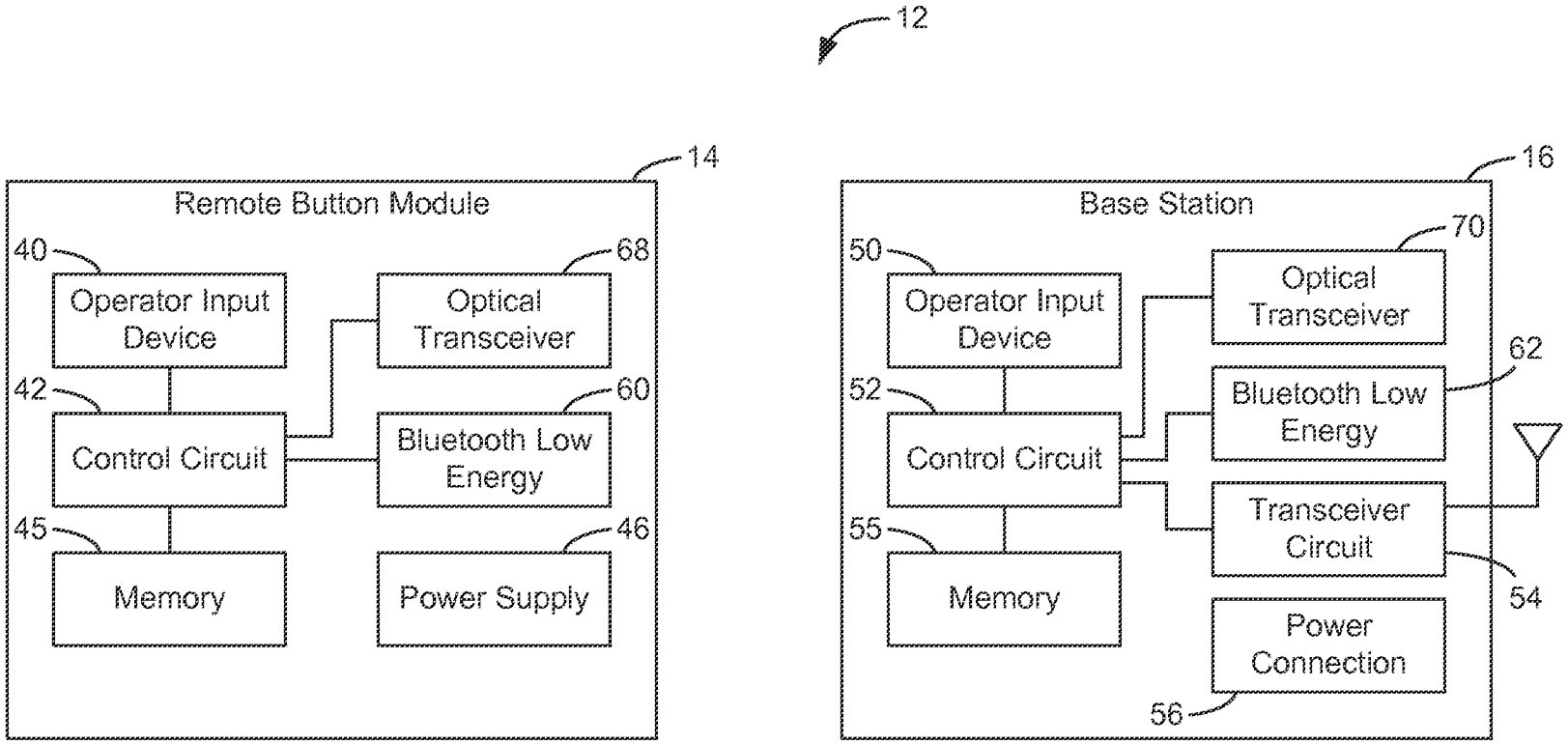
FIG. 4E illustrates an embodiment of the distributed remote system including an optical transceiver in the remote button module and in the base station.

FIG. 4E illustrates an embodiment of the distributed remote system 12 including an optical transceiver 68 in the remote button module 14 and an optical transceiver 70 in the base station 16. The optical transceivers 68 and 70 may be used in the manner described with reference to FIG. 4D and the NFC transceivers 64 and 66. The optical transceivers 68 and 70 may be used to pair the remote button module 14 and the base station 16. In other embodiments, the optical transceivers 68 and 70 may replace the BLE transceivers 60 and 62 for communication between the remote button module 14 and the base station 16. The optical transceivers 68 and 70 may allow for communication between the remote button module 14 and the base station 16. In some embodiments, the optical transceivers 68 and 70 may require a line of sight between the remote button module 14 and the base station 16 in order to allow communication between the two. Advantageously, this may increase the security of the distributed remote system 12 by requiring line of sight between the remote button module 14 and the base station 16.

Figure 4F:
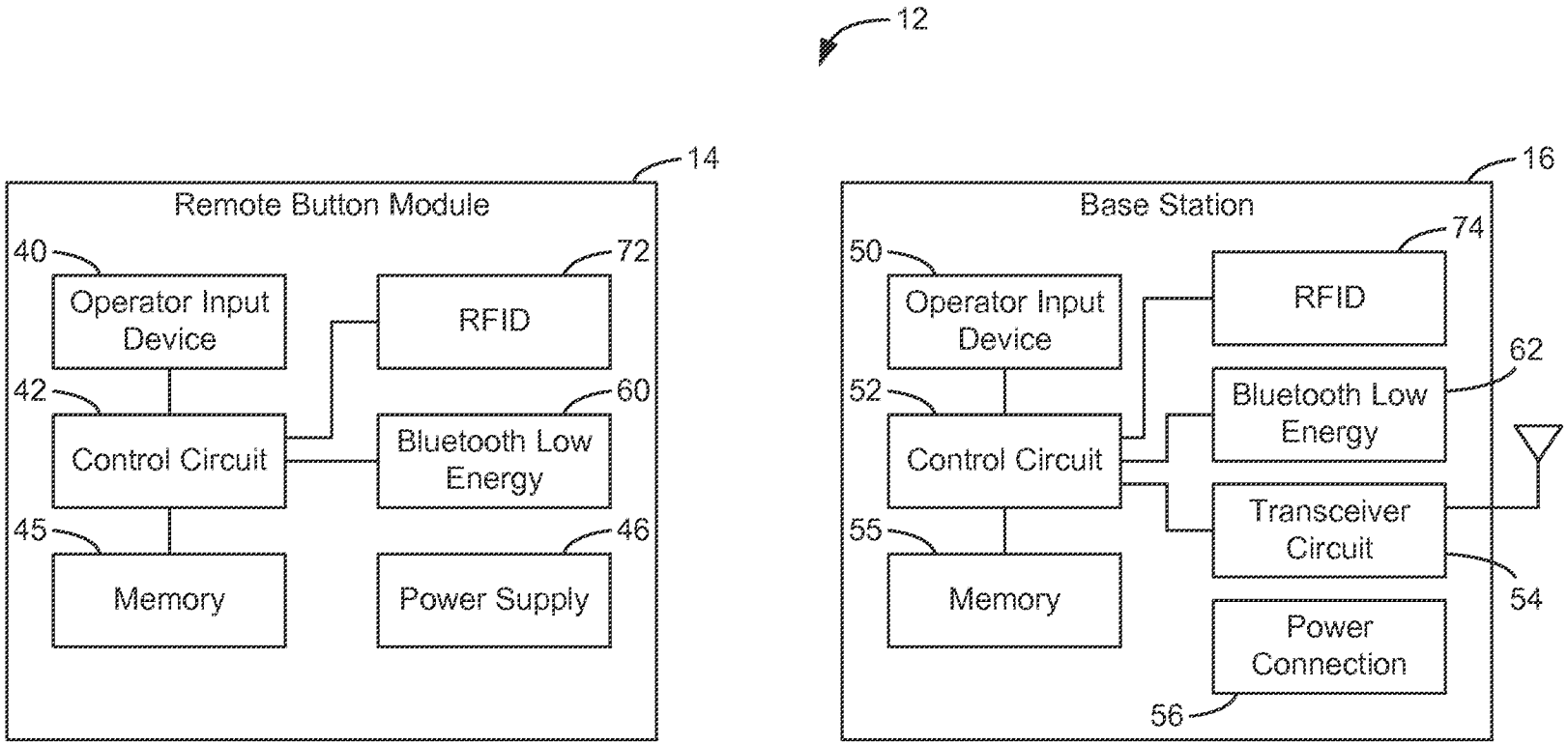
FIG. 4F illustrates an embodiment of the distributed remote system including a radio frequency identification circuit in the remote button module and in the base station.

FIG. 4F illustrates an embodiment of the distributed remote system 12 including a radio frequency identification circuit 72 in the remote button module 14 and a radio frequency identification circuit 74 in the base station 16. The radio frequency identification circuits 72 and 74 may be used in the manner described with reference to FIG. 4D and the NFC transceivers 64 and 66. The radio frequency identification circuits 72 and 74 may be used to pair the remote button module 14 and the base station 16. In other embodiments, the radio frequency identification circuits 72 and 74 may replace the BLE transceivers 60 and 62 for communication between the remote button module 14 and the base station 16. The radio frequency identification circuits 72 and 74 may allow for communication between the remote button module 14 and the base station 16. In some embodiments, the radio frequency identification circuits 72 and 74 may require close proximity between the remote button module 14 and the base station 16 in order to allow communication between the two. Advantageously, this may increase the security of the distributed remote system 12 by requiring close proximity between the remote button module 14 and the base station 16. In some embodiments, the remote button module 14 and/or the base station 16 may include one or more of the above communication hardware components described with reference to FIGS. 4A-F.

Figure 5A:
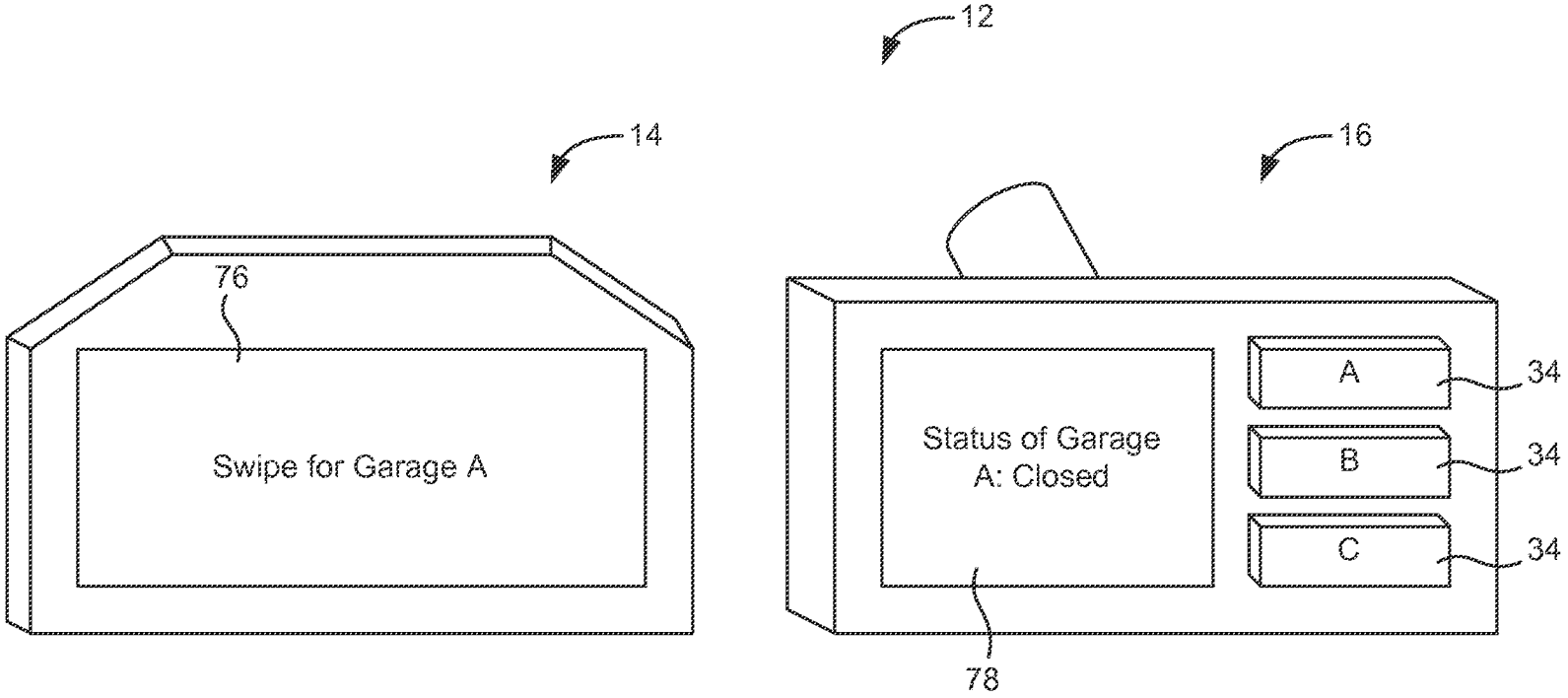
FIG. 5A illustrates an embodiment of the distributed remote system in which the remote button module and/or the base station include a touchscreen.

FIG. 5A illustrates an embodiment of the distributed remote system 12 in which the remote button module 14 and/or the base station 16 include a touchscreen. The remote button module 14 may include a touchscreen 76 for receiving user inputs and/or displaying output to a user. In some embodiments, the remote button module 14 has a single touchscreen input device 76 and no other input devices. In other embodiments, multiple touchscreens and/or other input devices may be included in the remote button module 14. The base station 16 may include a touchscreen 78 for receiving user inputs and/or displaying output to a user. In some embodiments, the base station 16 has a single touchscreen input device 78 and no other input devices. In other embodiments, multiple touchscreens and/or other input devices may be included in the base station 16. For example, the base station 16 may include three buttons 34 and a touchscreen 78. The touchscreens 76 and 78 may be any display configured to receiver user inputs through touch. For example, the touchscreens 76 and 78 may be a projected capacitive touchscreen, resistive touchscreen, or other touchscreen display. A touchscreen and/or other display (LCD, LED, plasma, etc.) on the remote button module 14 and/or base station 16 may display information such as pairing codes, home electronic device and/or remote device status (e.g., lights are on, garage door is open, etc.), the last command given to a remote device or home electronic device, the time, weather information, application information from a mobile device connected to the distributed remote system 12, or other information. In some embodiments, the buttons 34 of the base station 16 may correspond to different devices. For example, a first button 34 may send a control signal to device A, a second button 34 may send a control signal to device B, and a third button 34 may send a control signal to device C. In other embodiments, the buttons 34 of the base station 16 may correspond to other functions such as entering information, navigating displayed information, or providing other user inputs.

Figure 5B:
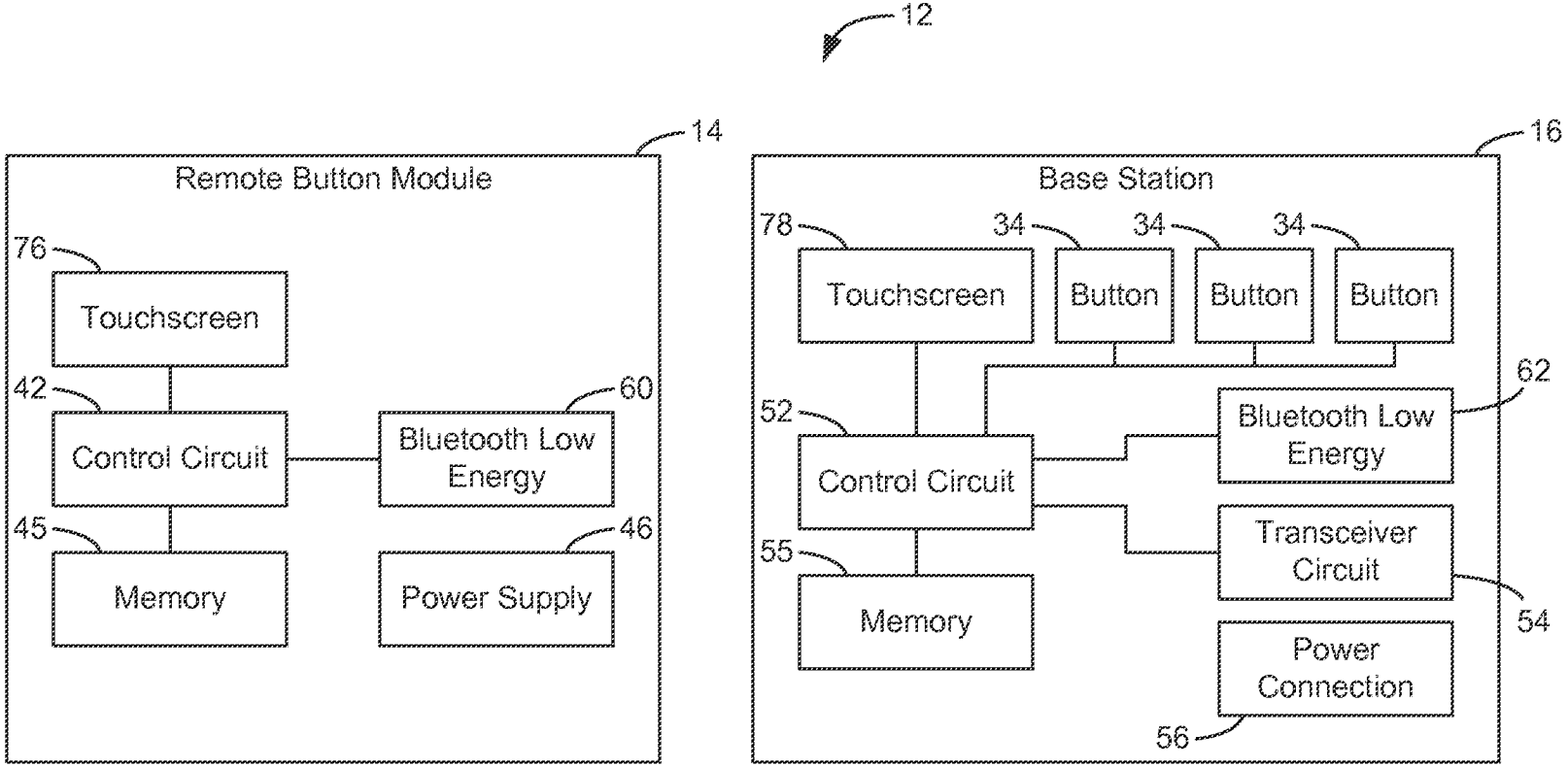
FIG. 5B illustrates a block diagram of the hardware corresponding to one embodiment of the base station and remote button module.

FIG. 5B illustrates a block diagram of the hardware corresponding to the embodiment illustrated in FIG. 5A. The touchscreens included in the remote button module 14 and the base station 16 may be coupled to the corresponding control circuits. In some embodiments, the touchscreen may include a controller and other hardware components such as processors, ICs, ASIC, memory, etc. In other embodiments, the control circuit may provide controller functionality for the touchscreen. For example, the control circuit may generate bitmaps and/or other graphic data for display by the touchscreen, handle user inputs, etc.

Figure 6A:
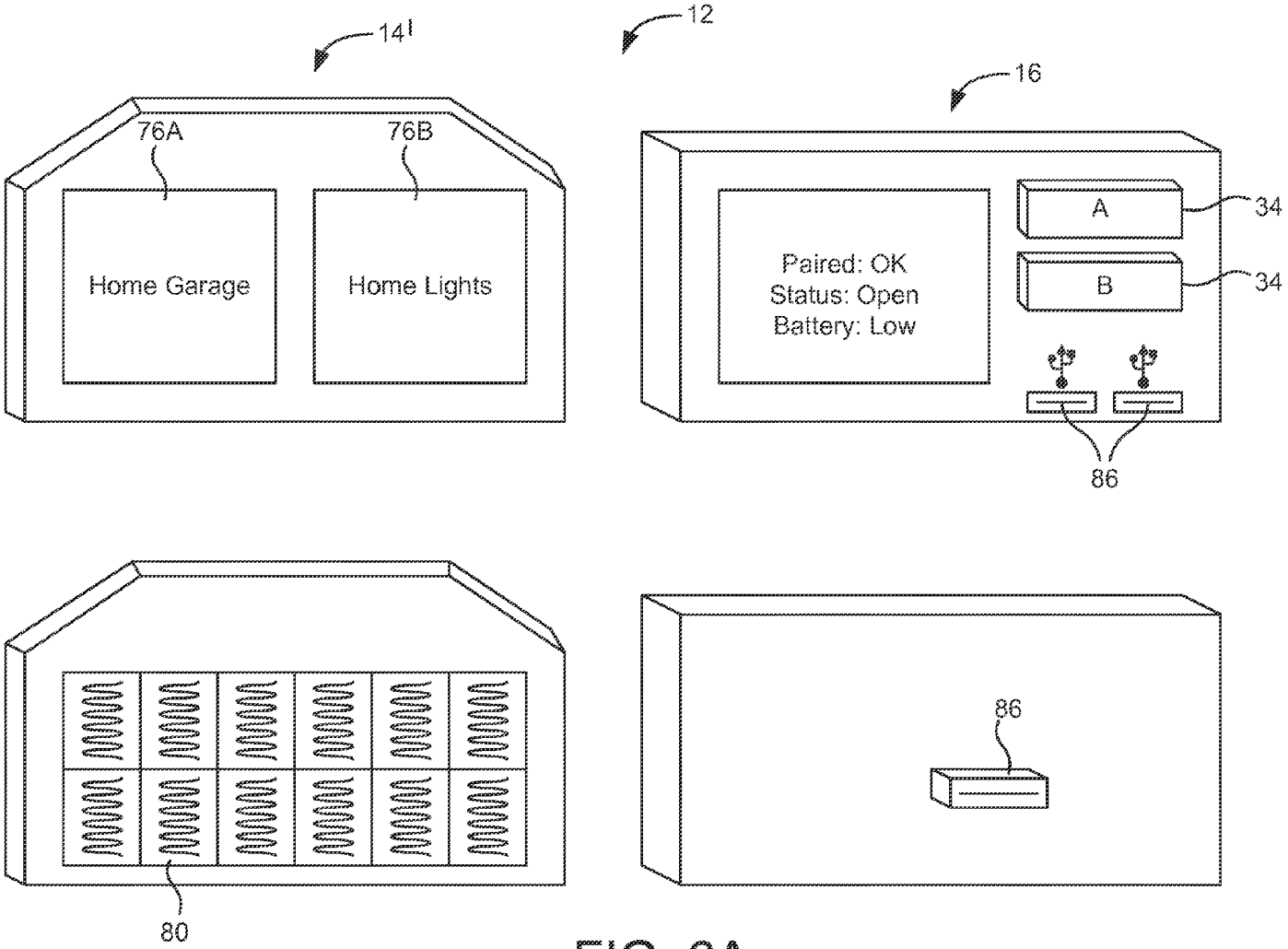
FIG. 6A illustrates an embodiment of the remote button module having two touchscreen displays and an embodiment of the base station having universal serial bus connection.
Figure 6B:
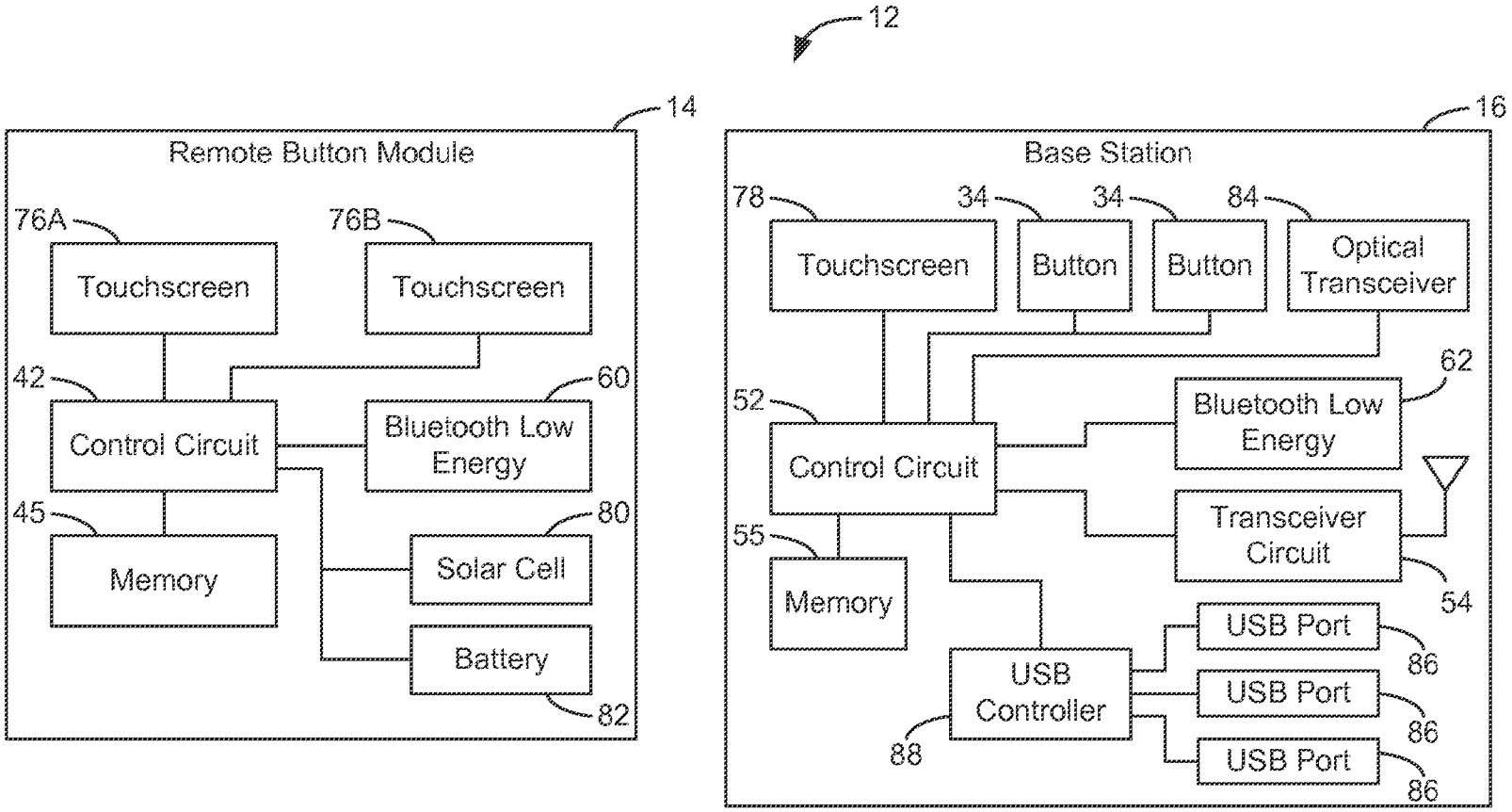
FIG. 6B illustrates a block diagram of the hardware corresponding to one embodiment of the base station and remote button module.

FIG. 6A illustrates an embodiment of the remote button module 14 having two touchscreen displays 76A and 76B. In other embodiments, other combinations of displays and/or user input devices discussed herein are possible. In some embodiments, the remote button module 14 may include one or more solar cells 80 as depicted in FIG. 6A. With reference to FIG. 6B, a solar cell 80 may be connected to one or more of the control circuit 42 and a battery 82. The solar cell 80 may provide a supplemental source of power for the remote button module 14. In some embodiments, the solar cell 80 may directly power components of the remote button module 14. In other embodiments, the solar cell 80 may charge the battery 82 of the remote button module 14. The solar cell 80 and/or the battery 82 may be controlled by the control circuit 42. The solar cell 80 may be connected directly to one or more components or indirectly through the battery 82. In some embodiments, other power sources may supplement or replace the battery 82. For example, the solar cell 80 may first charge a capacitor which provides power to components of the remote button module 14 and/or a battery 82. The solar cell 80 may be placed on the backside of the remote button module 14 such that it receives light through the windshield of a vehicle. Touchscreens 76A and 76B of the remote button module 14 may correspond to different devices controlled by the base station 16. In some embodiments, a user may provide a custom label for the devices which are controlled by the base station 16 and the remote button module 14. The label or labels may be displayed on one or more touchscreens of the remote button module 14. The customization may be performed using the base station 16. The base station 16 may provide information regarding whether the remote button module 14 is paired to the base station 16, the status of a device controlled by the distributed remote system 12 (e.g., that a garage door is open), the power remaining in a battery (e.g., the battery 82 in the remote button module 14), or other information related to the distributed remote system 12 or the devices controlled by the distributed remote system 12.

In some embodiments, the base station 16 may communicate with the remote button module 14 using an optical transceiver 84. The signals sent by the optical transceiver 84 of the base station 16 may be received by the solar cell 80 of the remote button module 14. For example, the base station 16 may send pairing information using the optical transceiver 84 to the solar cell 80 of the remote button module 14. The signal may be interpreted using the control circuit 52 coupled to the solar cell 80. Changes in voltage corresponding to the intensity of the light produced by the optical transceiver 84 may be converted to data or information by the control circuit 52 coupled to the solar cell 80.

With reference to FIG. 6A, some embodiments of the base station 16 may include USB ports 86. In some embodiments, the base station 16 connects to the vehicle 10 via a USB port of the vehicle. The base station 16 may include pass through USB ports 86 on the face of the base station 16. Advantageously, this allows the base station 16 to draw electrical power from the vehicle and allows a user to have access to the vehicle systems through the pass through USB ports 86 on the base station 16. In some embodiments, the pass through USB ports 86 of the base station 16 may be configured to charge user devices connected via the pass through USB ports 86. The base station 16 may include a USB port 86 on the rear of the base station 16 in order to connect to the vehicle USB port. In some embodiments, the base station 16 may connect to the vehicle using a flexible USB cord. In other embodiments, a positionable (e.g., with hinges) USB connector connects the base station 16 to the vehicle. In some embodiments, the base station 16 may also include a 12 volt power port. In other embodiments (e.g., in which the base station 16 connects to 12 volt power port), the base station 16 may include a pass through 12 volt power port.

With reference to FIG. 6B, the base station 16 may include a USB controller circuit 88 to manage USB connections provided by the base station 16 and/or the USB connection between the base station 16 and the vehicle or the base station 16 and other devices. In some embodiments, the functions of the USB controller 88 may be performed by the control circuit 52.

Figure 7A:
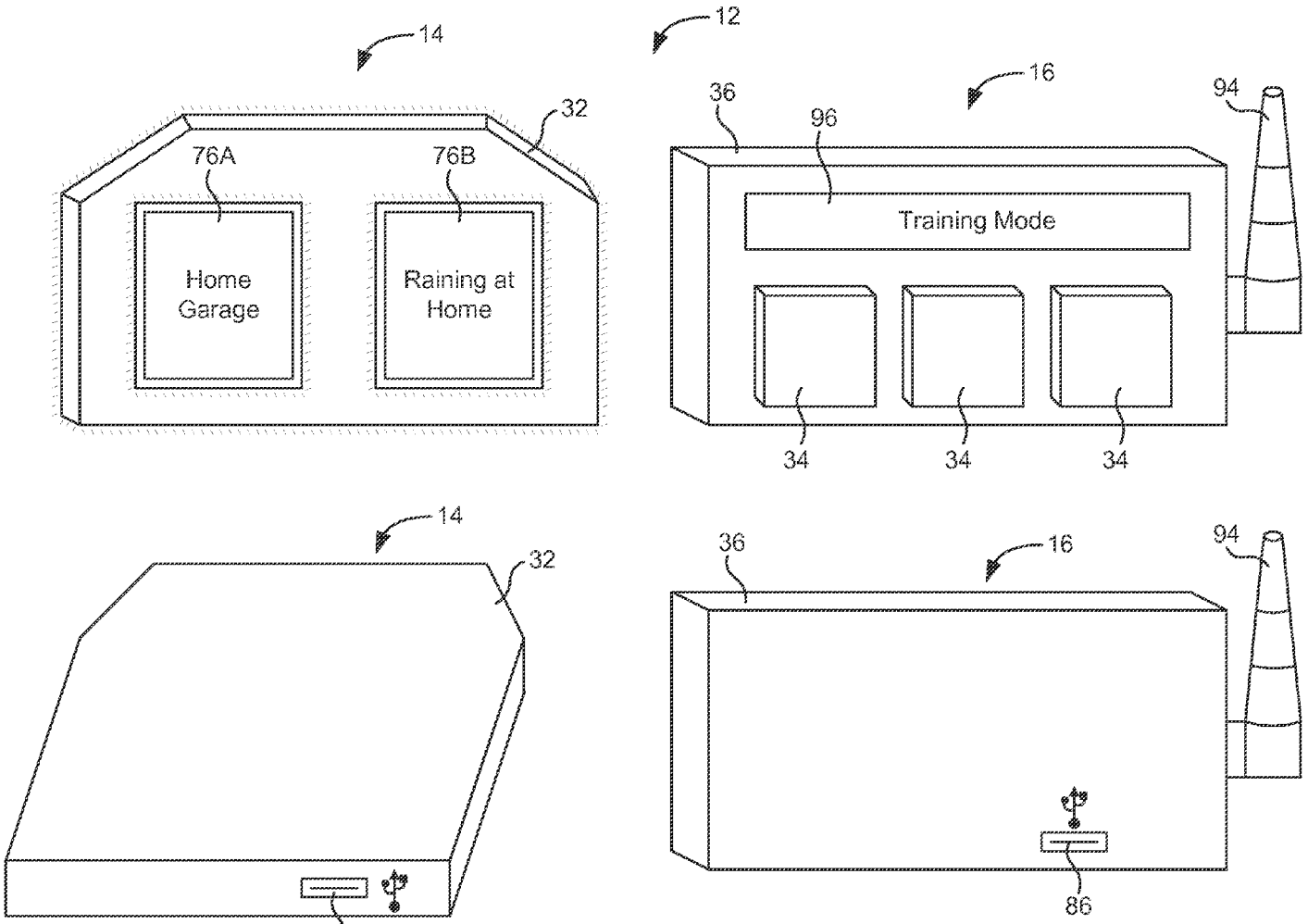
FIG. 7A illustrates an embodiment of the remote button module having backlighting and an embodiment of the base station having an external antenna.

FIG. 7A illustrates an embodiment of the remote button module 14 including lighting devices. The remote button module 14 may include lighting devices which illuminate all or part of the remote button module 14. For example, lighting devices may illuminate the operator input devices (e.g., buttons 30, touchscreens 76A and 76B, etc.) of the remote button module 14. In other embodiments, the bezel and/or housing 32 of the remote button module 14 may be illuminated. In some embodiments, the remote button module 14 may be backlit (e.g., the entirety of or a portion of remote button module 14 backlit). In further embodiments, illumination may be backlighting of operator input devices of the remote button module 14. Lighting devices may include luminescent material, LEDs, display screens, etc. For example, a glow ring may be included on the remote button module 14. Luminescent material may be included in, on, or make up part of or the entirety of the bezel and/or housing 32 of the remote button module 14. In some embodiments, back lighting (e.g., by one or more LEDs) may be activated when a proximity sensor detects a user. For example, when a user moves his or her hand into a detection zone defined by the specifications of the proximity sensor, the proximity sensor detects the user and the control circuit 42 activates backlighting of the operator input device. In further embodiments, backlighting may be activated upon receiving a user input (e.g., LED is illuminated, touchscreen displays an image, etc.). This may provide visual feedback to a user. In additional embodiments, the base station 16 includes backlighting of the type discussed herein.

In some embodiments, the remote button module 14 may include a USB port 90 as illustrated in FIG. 7A. The USB port 90 (e.g., micro USB port) may be located on the side, bottom, rear, front, or other face of the remote button module 14. In some embodiments, the remote button module 14 may be recharged from a power source using the USB port 90. In other embodiments, the remote button module 14 may receive or output information using the USB port 90.

Figure 7B:
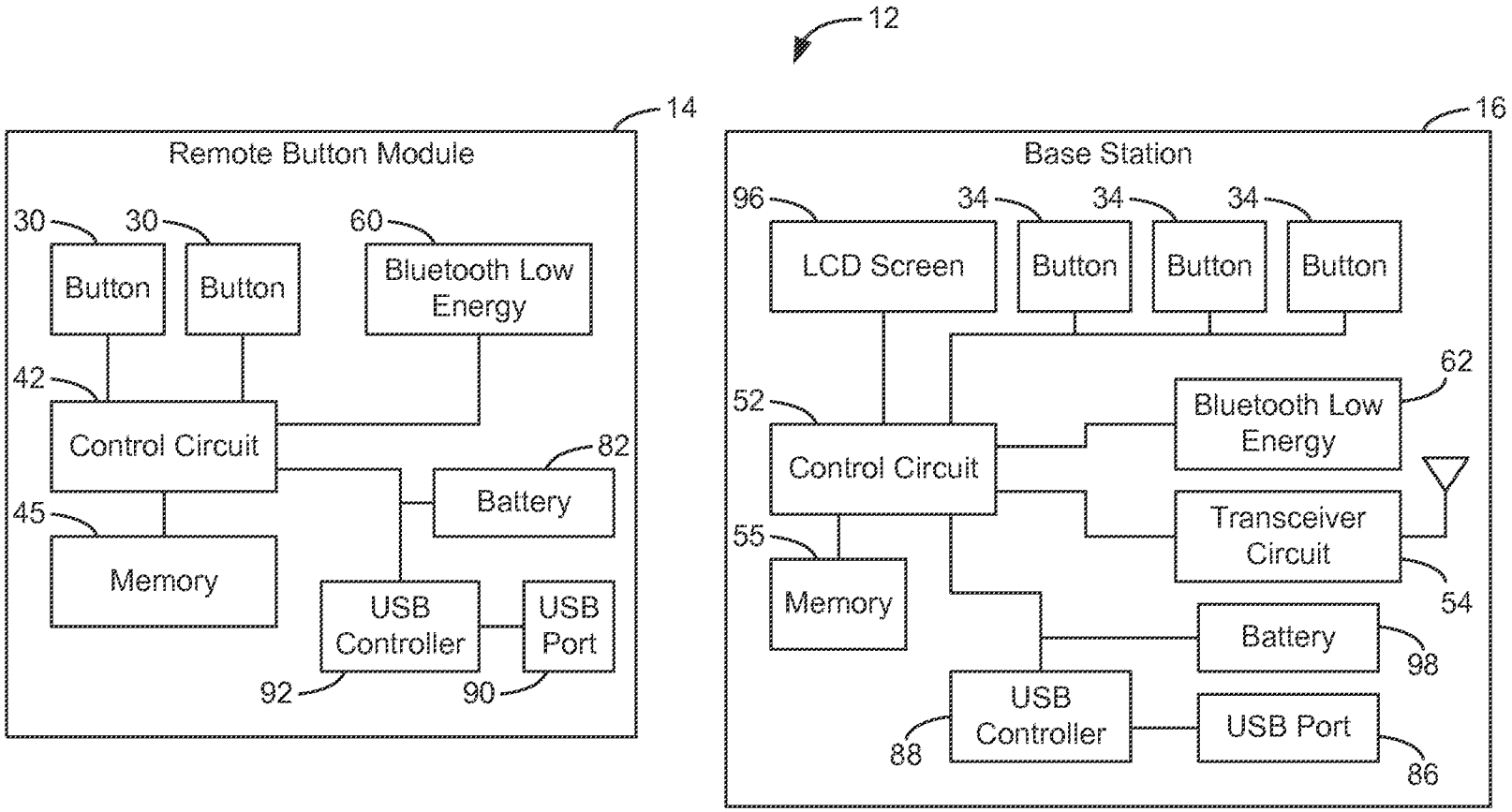
FIG. 7B illustrates a block diagram of the hardware corresponding to one embodiment of the trainable transceiver base station and remote user interface module.

FIG. 7B illustrates the remote button module 14, according to one embodiment, including a USB controller 92. As previously discussed, the USB controller 92 may control the USB port 90 and/or facilitate the functions described above.

Referring again to FIG. 7A, in some embodiments, the base station 16 may have an external or partially external antenna 94. The antenna 94 may be a component of the transceiver circuit 54 or be connected to the transceiver circuit 54. In some embodiments, the position of the external antenna 94 may be adjustable by a user. In further embodiments, the external antenna 94 may be a wire antenna. In other embodiments, the external antenna 94 may be located remote to the base station 16 and connected thereto by a wire or other electrical connection or a wireless connection. In other embodiments, the base station 16 may include an internal antenna. The internal antenna may be located entirely or partially within the housing of the base station 16. In some embodiments, the housing 36 or a portion of the housing of the base station 16 may function as an antenna. In other embodiments, the antenna 94 may be hinged such that it may be positioned and/or hidden, may be removable (e.g., unscrew from the base station 16), may be flexible, may be a loop antenna, and/or may be another type or structure.

In some embodiments, the base station 16 may include a display 96 (e.g., LCD, LED, plasma, e-ink, or other display) as well as other operator input devices (e.g., buttons 34). The display 96 may be used to display information to a user. For example, the display 96 may be used to display a pairing code, home electronic device or remote device status or information, the last command transmitted by the base station 16, whether the base station 16 is in training mode, or other information related to the distributed remote system 12 or a device controlled by the system.

The remote button module 14 may also display information or data received from the base station 16. In some embodiments, the base station 16 may forward data to the remote button module 14 that the base station 16 has received from a home electronic device and/or remote device. For example, the base station 16 may receive data from a weather device that it is raining at the user's home. The base station 16 may communicate this data to the remote button module 14 which may display it to the user on a display and/or touchscreen.

In some embodiments, the base station 16 may include a rechargeable battery 98. The rechargeable battery 98 may be recharged using a USB port 86 of the base station 16 and a connection to a power source. In other embodiments, the remote button module 14 and the base station 16 may be paired by connecting a USB port 90 on the remote button module 14 to a USB port 86 on the base station 16.

Referring now to FIG. 7B, the base station 16 may include a USB controller 92. The USB controller 92 may have the same functions previously described. In some embodiments, the USB controller 92 and/or the control circuit 42 may allow the remote button module 14 and the base station 16 to be paired over a USB connection. In embodiments of the base station 16 including a display 96 (e.g., LCD screen), the LCD screen is connected to the control circuit 52. The control circuit 52 and/or the LCD screen may function as a controller for the LCD screen. A battery 98 may be connected to the USB controller 88 in order to recharged through the USB port 86. The battery 98 may be connected to the control circuit 52 and or other components directly or indirectly. The battery 98 provides electrical power to components of the base station 16.

Figure 8A:
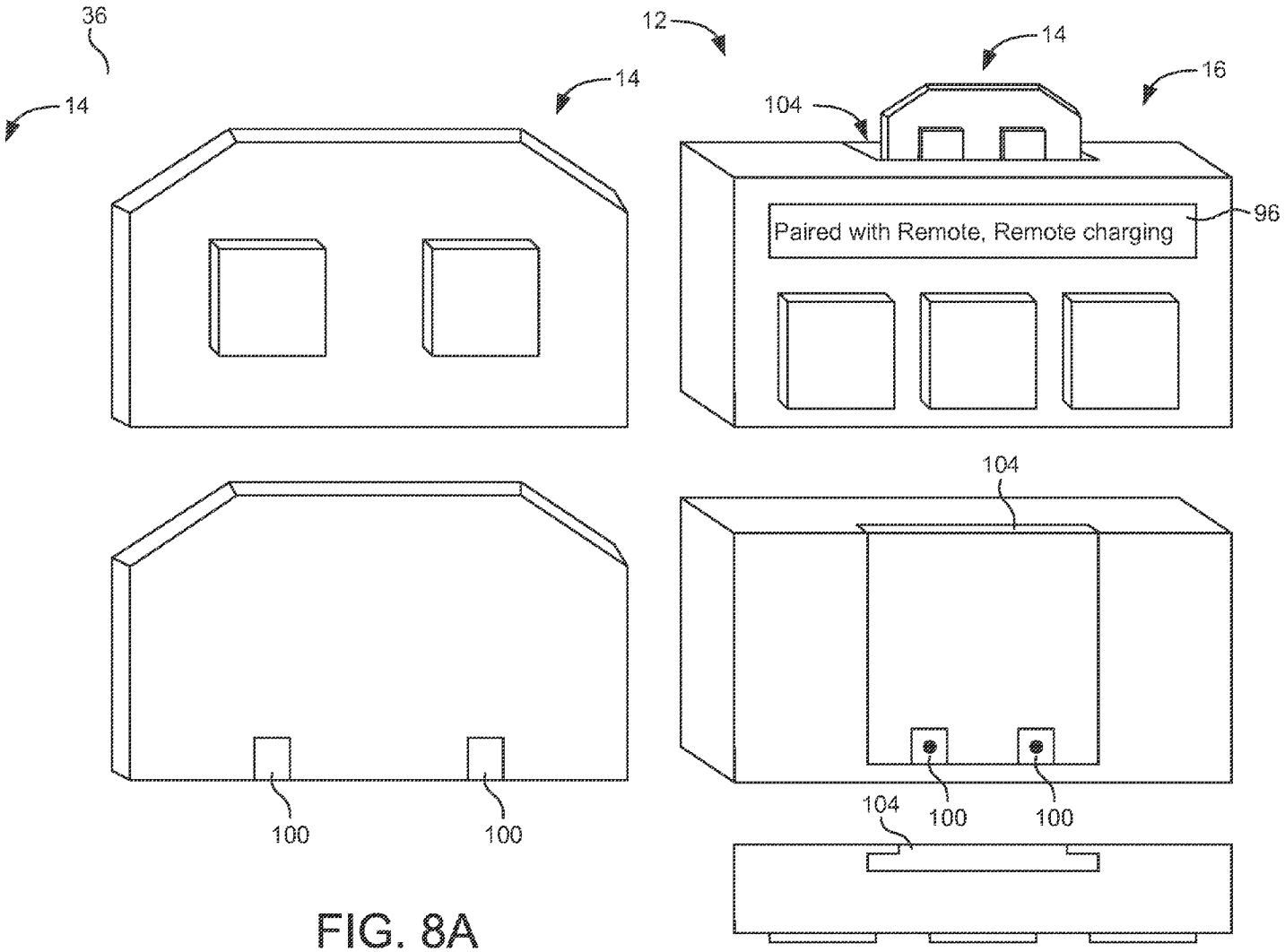
FIG. 8A illustrates an embodiment of the remote button module and the base station which include contacts.

FIG. 8A illustrates an embodiment of the remote button module 14 and the base station 16 which include contacts. In some embodiments, the contacts 100 of the remote button module 14 are located on the rear of the remote button module 14 and the contacts 102 of the base station 16 are located on the rear of the base station 16. Two or more contacts may be included on the remote button module 14 and/or the base station 16. In one embodiment, the remote button module 14 and the base station 16 are brought into electrical connection through contact between the contacts 100 of the remote button module 14 and the contacts 102 of the base station 16. In one embodiment, the remote button module 14 is inserted into a slot or groove 104 of the base station 16 which holds the remote button module 14. The contacts 100 and 102 and or the configuration of the slot or groove 104 may hold the remote button module 14 in place until a user removes the remote button module 14. In other embodiments, the remote button module 14 may snap into the base station 16 to be brought into electrical contact with the base station 16 through the contacts 100 and 102. A user may remove the remote button module 14 by unsnapping the remote button module 14 from the base station 16. In some embodiments, the snapping functionality is achieved by having a tab, overhang, etc. which plastically deforms. The remote button module 14 may be inserted by deforming the securing feature which returns to its original shape and secures the remote button module 14 once it has cleared the securing feature.

In some embodiments, the contacts 100 and 102 allow for the remote button module 14 to be recharged using the connection to the base station 16 provided by the contacts. In other embodiments, the contacts 100 and 102 allow data transfer between the remote button module 14 and the base station 16. For example, the connection between the contacts 100 of the remote button module 14 and the contacts 102 of the base station 16 may allow the remote button module 14 to be paired with the base station 16. Advantageously, this provides security to the distributed remote system 12 because the remote button module 14 and the base station 16 may be physically paired in order to be wirelessly paired. A user would have to have physical access to both components of the distributed remote system 12. In some embodiments, a display screen 96 of the base station 16 may display information while the remote button module 14 is in communication with the base station 16 such as whether the battery 82 of the remote button module 14 is charging, the remaining battery power of the remote button module 14, whether the remote button and the base station 16 are paired, or other information about the distributed remote system 12.

Figure 8B:
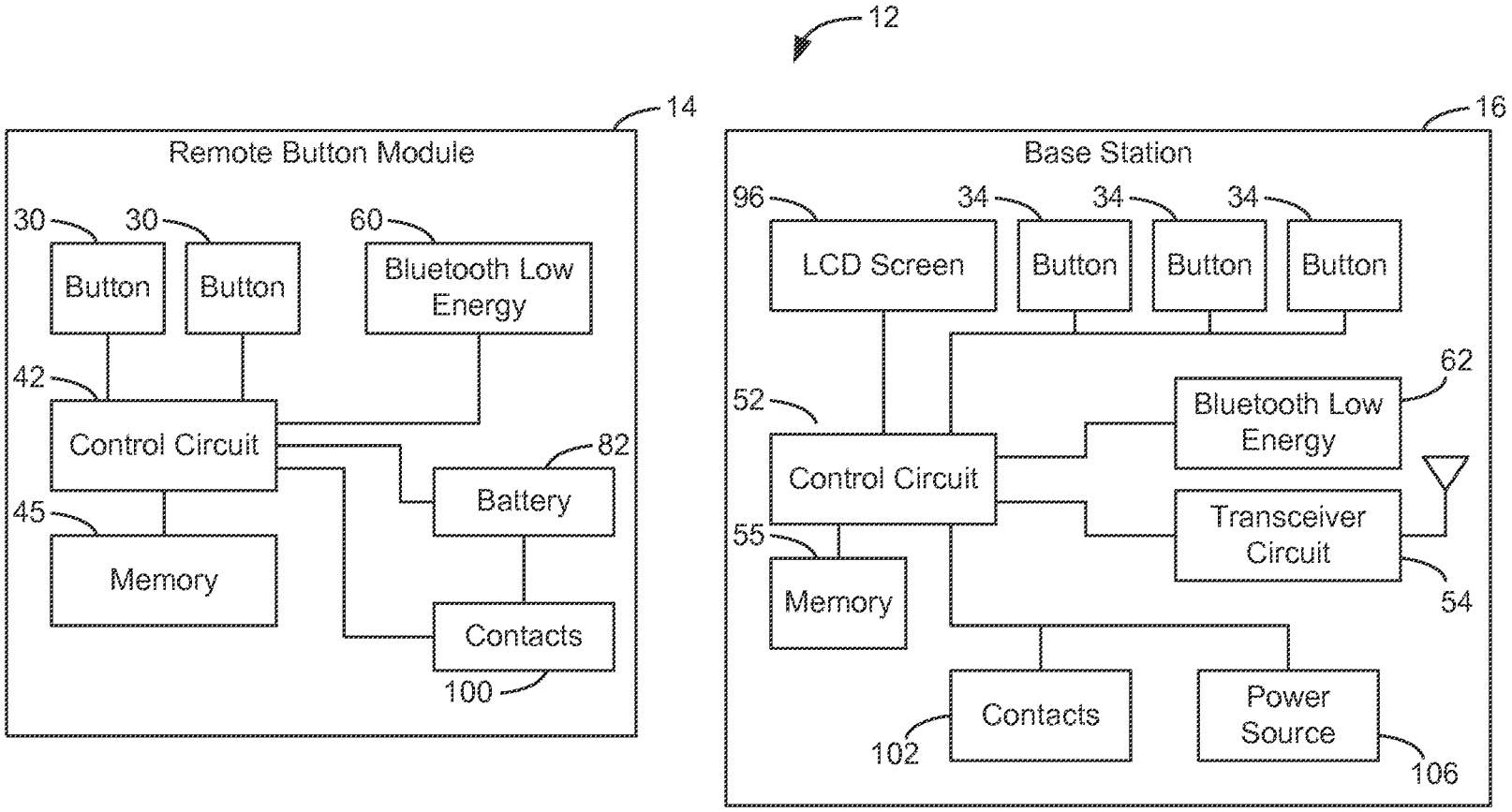
FIG. 8B illustrates a block diagram of the hardware corresponding to one embodiment of the base station and remote button module.

Referring now to FIG. 8B, the contacts 100 of the remote button module 14 and/or the base station 16 may be connected to the control circuit 42 and or the battery 82. In some embodiments, one or more contacts 100 are connected to the battery 82 while a different one or more contacts 100 are connected to the control circuit 42. The control circuit 42 may allow for communication (e.g., data transfer) between the contacts 100 of the remote button module 14 and the contacts 102 of the base station 16. The contacts 100 connected with the battery 82 of the remote button module 14 may allow the battery 82 of the remote button module 14 to be recharged using an electrical connection to the contacts 102 of the base station 16. The contacts 102 of the base station 16 may in turn be connected to a power source 106 (e.g., 12 volt power plug).

Figure 8C:
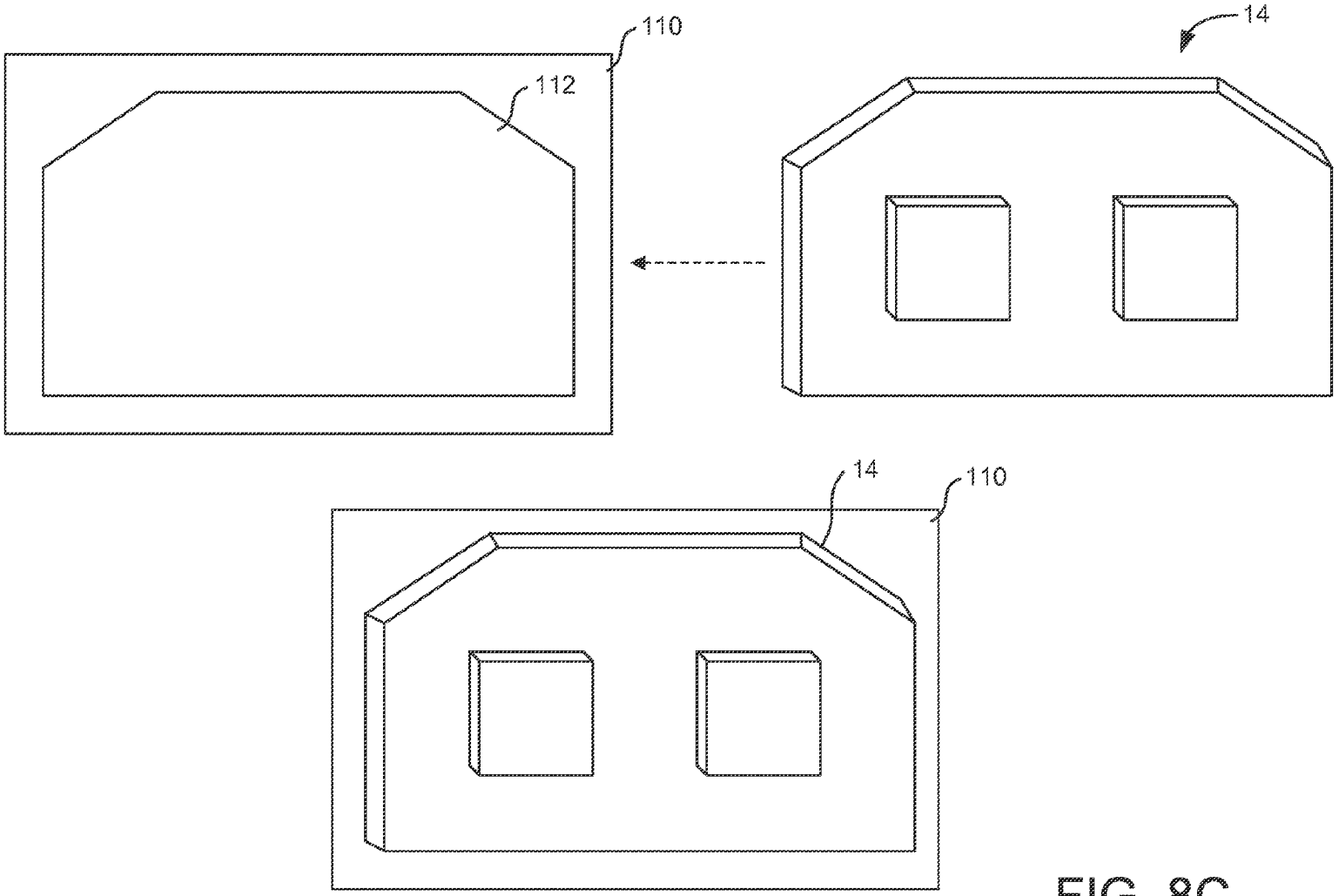
FIG. 8C illustrates one embodiment of a carrier for the remote user interface module.

FIG. 8C illustrates one embodiment of a carrier 110 for the remote button module 14. The carrier 110 may hold or otherwise secure the remote button module 14. In one embodiment, the carrier 110 is configured to allow a user to snap the remote button module 14 into the carrier 110. In some embodiments, the carrier 110 is configured as previously discussed to allow a user to snap the remote button module 14 into the carrier 110. Similarly, a user may remove the remote button module (e.g., to be recharged, paired, etc.) by unsnapping the remote button module 14 from the carrier 110. The carrier 110 may include a window 112 so as to allow a user access to the remote button module 14 including features or components such as operator input devices (touchscreens, buttons, etc.) and/or output devices (e.g., speakers, backlighting, etc.). The carrier 110 may be attached to the vehicle 10 using the techniques previously described (e.g., PSA, foam tape, etc.). Advantageously, the carrier 110 may be attached to the vehicle such that the carrier 110 then allows the remote button module 14 to be removed and inserted and thereby attached to the vehicle 10 through the carrier 110 without having to attach the remote 14 using an adhesive or similar attachment device. The remote button module 14 is easily attached and removed from the vehicle 10 using the carrier 110 while the carrier 110 remains in place. In some embodiments, the carrier 110 may be shaped and/or colored so as to mimic the interior style of a vehicle. In further embodiments, the carrier 110 may be configured to have a bezel attached (e.g., snapped) to the carrier. The bezel may mimic the interior of a particular vehicle.

Figure 8D:
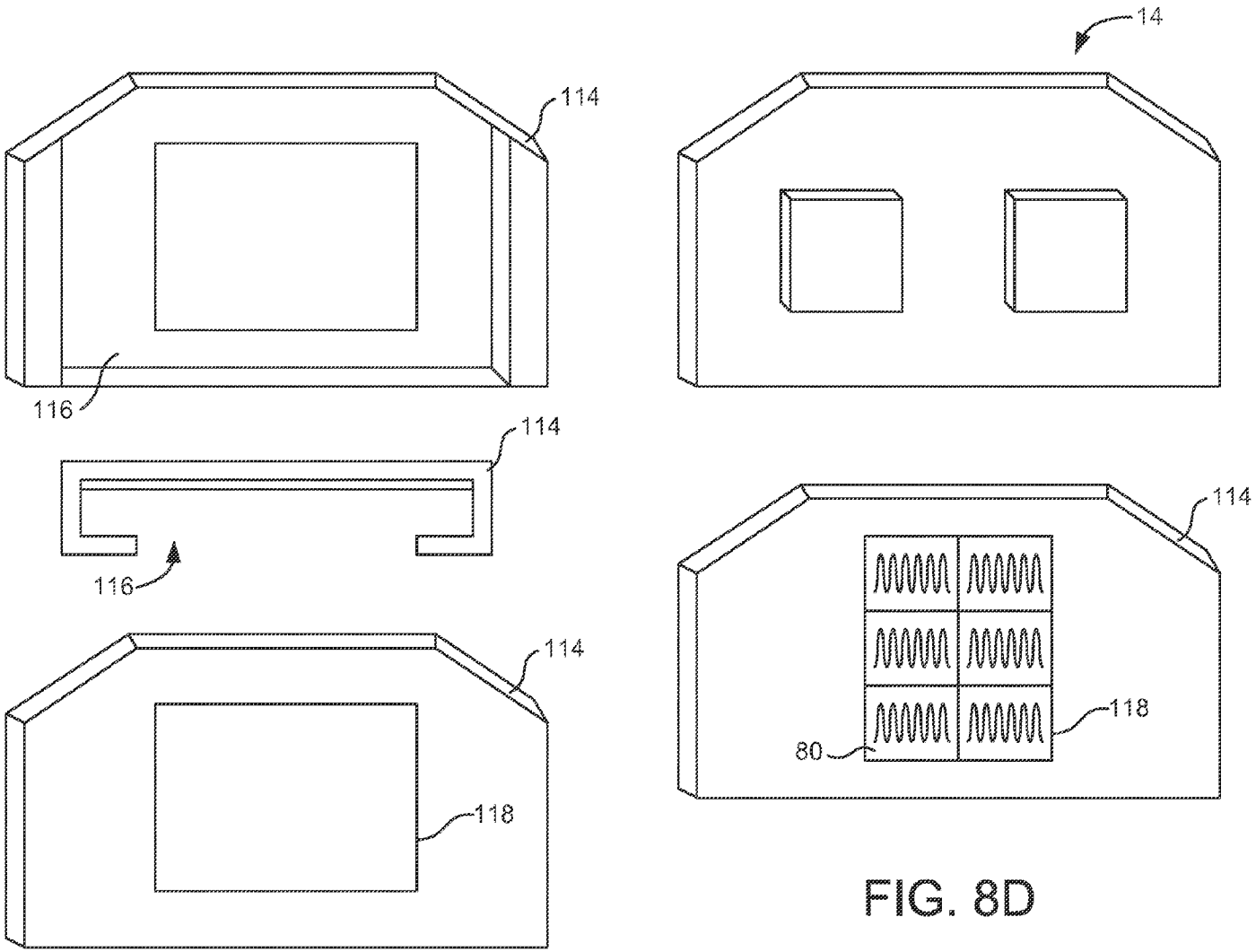
FIG. 8D illustrates an alternative exemplary embodiment of a carrier.

FIG. 8D illustrates an alternative embodiment of a carrier 114. The carrier 114 may include a slot or groove 116 for receiving the remote button module 14. For example, a user may slide the remote button module 14 into the carrier 114 from the top of the carrier 114. The carrier 114 may secure the remote button module 14 using an interference fit with the housing of the remote button module 14. In other embodiments, the contacts of the remote button module 14 or another feature (e.g., a protrusion of the housing) may secure the remote button module 14 in the carrier 114. In some embodiments, the carrier 114 may include a window 118 (e.g., Plexiglas, transparent plastic, etc.) or a cutout which allows a solar cell 80 of the remote button module 14 to receive light.

In some embodiments, the attachment mechanism which allows the remote button module 14 to be attached to the carrier 114 is the same mechanism which allows the remote button module 14 to be attached to the base station 16. For example, the base station 16 includes a slot 104 to receive the remote button module 14, and the carrier 114 includes a slot 116 to receive the remote button module 14.

Figure 9A:
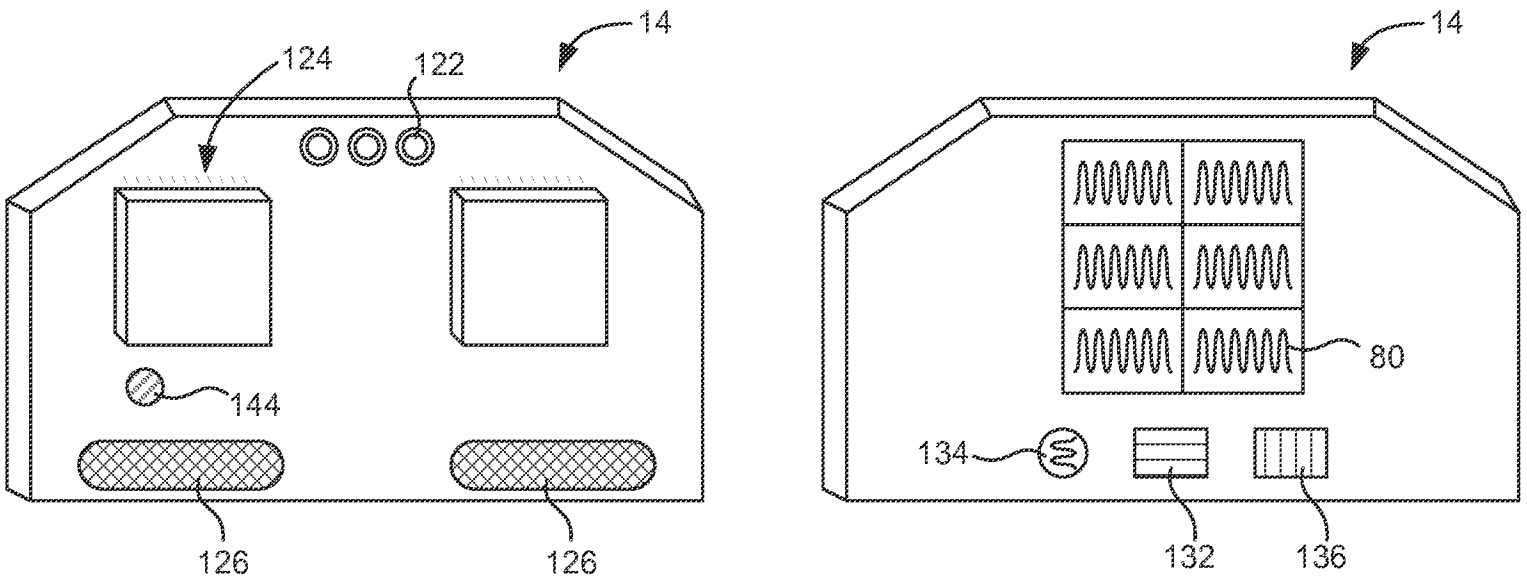
FIG. 9A illustrates an embodiment of the remote button module which includes additional components
Figure 9B:
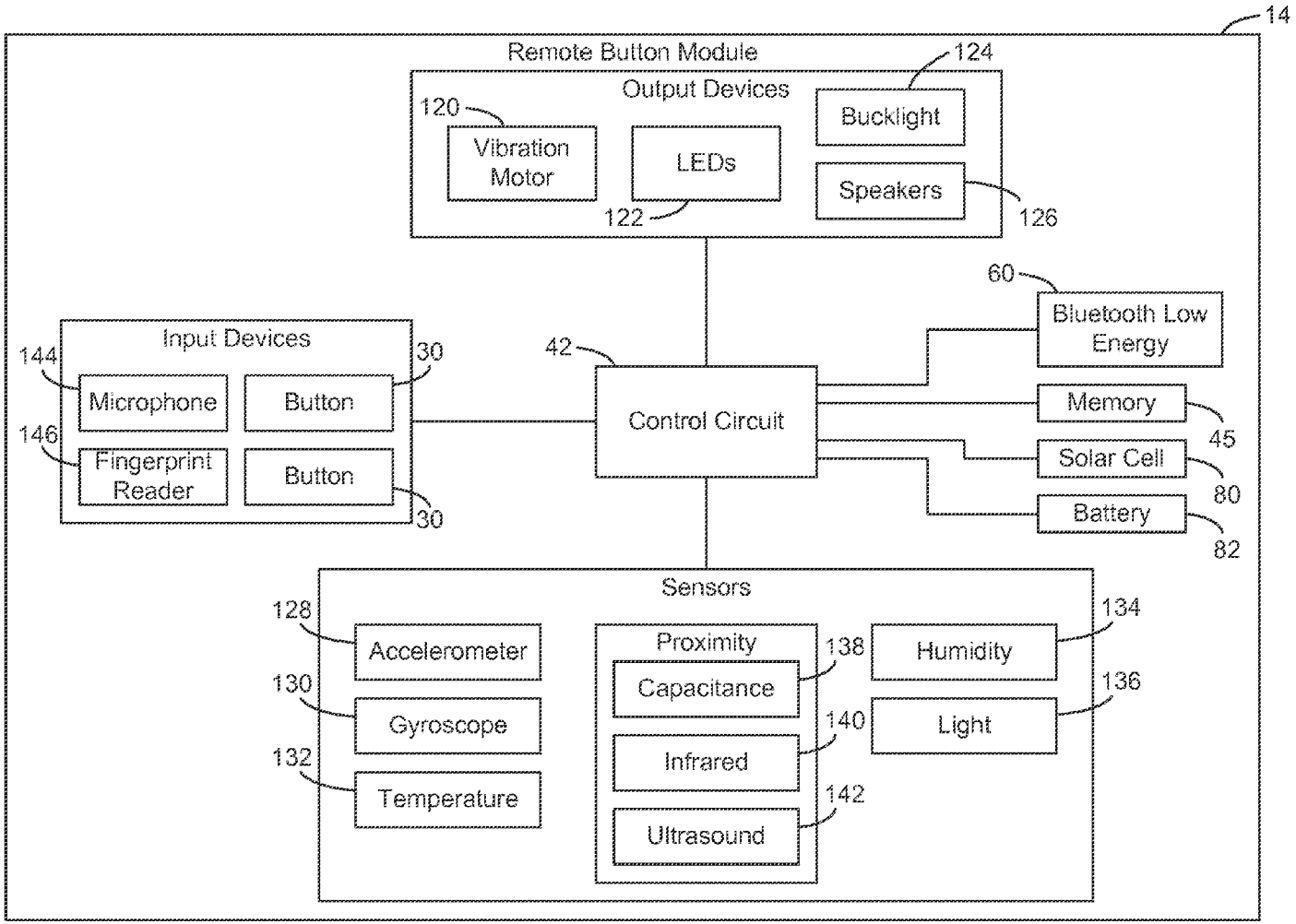
FIG. 9B illustrates a block diagram of the hardware corresponding to one embodiment of the remote button module.

FIG. 9A illustrates an embodiment of the remote button module 14 which includes additional components. With reference to FIGS. 9A and 9B, the additional components described herein may be connected with the control circuit 42. The control circuit 42 may receive inputs from provide outputs to, control, or otherwise support the functions of the additional components described herein. In some embodiments, the remote button module 14 includes a vibration motor 120. The vibration motor 120 may provide haptic feedback to a user of the remote button module 14. For example, the vibration motor 120 may be activated upon the control circuit 42 receiving a user input, upon successful pairing or the remote button module 14 to a base station 16, after the distributed remote system 12 has been trained, paired with, or enrolled to operate with a home electronic device and/or remote device, etc. In additional embodiments, the remote button module 14 includes one or more LEDs 122. The LEDs 122 may display to the user information regarding the power remaining in the battery 82, that an input has been received, etc. Combinations of LEDs, color, blinking, etc. may be used to communicate information to the user. In other embodiments, the remote button module 14 includes backlighting sources 124. In further embodiments, the remote button module 14 includes one or more speakers 126 (e.g., piezoelectric device). Speakers 126 may be used to provide audio feedback to a user.

In some embodiments, the remote button module 14 may include one or more sensors. In some embodiments, the remote button module 14 includes an accelerometer 128. The accelerometer 128 may measure the movement of the remote button module 14. In some embodiments, the accelerometer 128 may detect user taps on the remote button module 14 (e.g., on a screen, the housing of the remote button module 14, a hard key button, etc.). The number of taps received may correspond to different functions of the remote button module 14. For example, if a defined number of taps are detected within a defined time window, the control circuit may put the remote button module 14 into a pairing mode which allows the base station 16 and/or a remote device to pair to the remote button module 14. In other embodiments, other input combinations place the remote button module 14 into a paring mode (e.g., spinning or rotating the remote button module 14, lowering the remote button module 14, raising the remote button module 14, changing the orientation of the remote button module 14, or otherwise physically interacting with the remote button module 14). In some embodiments, the number of taps may correspond to different functions of the remote button module 14. For example, if the remote user interface module is tapped two times, the remote button module 14 may control a remote device. If the remote button module 14 is tapped three times, the remote button module 14 may control a home electronic device. Taps may be used in combination with other user input devices in some embodiments. In some embodiments, the remote button module 14 includes a gyroscope 130, temperature sensor 132, humidity sensor 134, and/or light sensor 136. In some cases data gathered by one or more of these sensors may be displayed on the remote button module 14 and/or the trainable transceiver base station 16. For example, the remote button module 14 and/or base station 16 may display or otherwise output (e.g., audio output, data transmission, etc.) the temperature detected by the temperature sensor 132. In some embodiments, one or more of the sensor inputs may be used to control the remote button module 14 and/or the base station 16. For example, the brightness of a display on the remote button module 14 and/or the base station 16 may be adjusted according to the light intensity detected by the light sensor 136, backlighting 124 may be turned on in low light environments as detected by the light sensor 136, etc. Some embodiments of the remote button module 14 include one or more proximity sensors. For example, the remote button module 14 may include a projected capacitance sensor 138, infrared sensor 140, ultrasound sensor 142, etc. Input from a triggered proximity sensor may be used by the control circuit 42. For example, the control circuit 42, in response to a triggered proximity sensor, may turn on a display, activate backlighting, send a control signal, transmit data, send an instruction, etc.

In some embodiments, remote button module 14 includes input devices other than or in addition to buttons 30, touchscreen displays, capacitance based touch sensors, or other physical input devices. In some embodiments, the remote button module 14 includes one or more microphones 144. Microphones 144 may be used by the remote button module 14 to accept voice commands from a user. In some embodiments, the remote button module 14 may receive voice commands through a remote device (e.g., smartphone) with a microphone that is paired to the distributed remote system 12. In some embodiments, remote button module 14 includes fingerprint reader 146. Fingerprint reader 146 may be a touchscreen display, imager, or other device adapted to read a fingerprint of a reader. Alternatively, fingerprint reader 146 may be a dedicated device for identifying or reading fingerprints. Remote button module 14 may use input from fingerprint reader 146 to identify a user. The identity of the user may be used as a security measure to prevent unauthorized users from using remote button module 14. The identity of the user may be used to set user specific preferences for remote button module 14 (e.g., assigning specific inputs to specific actions). For example, the identity of the user may be used to assign specific buttons 30 or other input devices to control specific home electronic devices 20 and/or remote devices 22.

In some embodiments, the base station 16 may include one or more of the additional components described with reference to FIGS. 9A and 9B above. Remote button module 14 and/or base station 16 may include various subset of the previously described components in various embodiments.

Generally, the hardware components described above may form a human machine interface for interaction between the distributed remote system 12 and the user. Human machine interface techniques supported by the hardware of the remote button module 14 and/or the base station 16 may include providing user feedback or interactions. User feedback or interactions may include visual feedback through a display (e.g., touchscreen, LCD screen, etc.), audio voice prompts (e.g., an audio prompt to provide a voice command), backlighting or other lighting (e.g., in response to a system event or user input), haptic feedback, etc. Human machine interface techniques supported by the hardware of the remote button module 14 and/or the base station 16 may include receiving user inputs as previously discussed. In addition, some embodiments of the distributed remote system 12 may support user inputs such as gestures performed suing a touchscreen, voice commands (e.g., provided in response to an audio prompt triggered by pressing an holding a user input device), etc.

Referring generally to FIGS. 10A-10E, the remote button module 14 may be paired with the base station 16 by the user and using a pairing process. In some embodiments, a remote button module 14 and a base station 16 only communicate (beyond sending and receiving pairing requests and pairing information) if they are first paired by the user. This provides an advantage of security to the distributed remote system 12. Pairing may include pairing the remote button module 14 and the base station 16 according to a Bluetooth protocol, NFC protocol, encryption protocol, or other pairing or encryption protocol. In some embodiments, the remote button module 14 and the base station 16 may be paired with one or more techniques. In some embodiments, the remote button module 14 and the base station 16 are paired without any user input. For example, the remote button module 14 and the base station 16 may be paired using an NFC protocol if the remote button and the base station 16 are within a sufficiently close distance to one another to allow NFC communication. For example, this distance may be less than five centimeters.

In some embodiments, new or replacement remote button modules 14 may be paired with a base station 16 prior to the remote buttons being able to communicate with the base station 16. A new or replacement remote button module 14 may be paired to a base station 16 according to one or more of the techniques described herein. In other embodiments, a new or replacement remote button module 14 may be preprogrammed with information allowing the remote button module 14 to communicate with the base station 16. For example, a user may order a new or replacement remote button and in doing so give identification information to a supplier regarding the base station 16. The supplier may then preprogram the remote button module 14 with the information (e.g., encryption information) such that the new or replacement remote button module 14 may communicate with the base station 16 without first being paired to the base station 16 by a user.

Figure 10A:
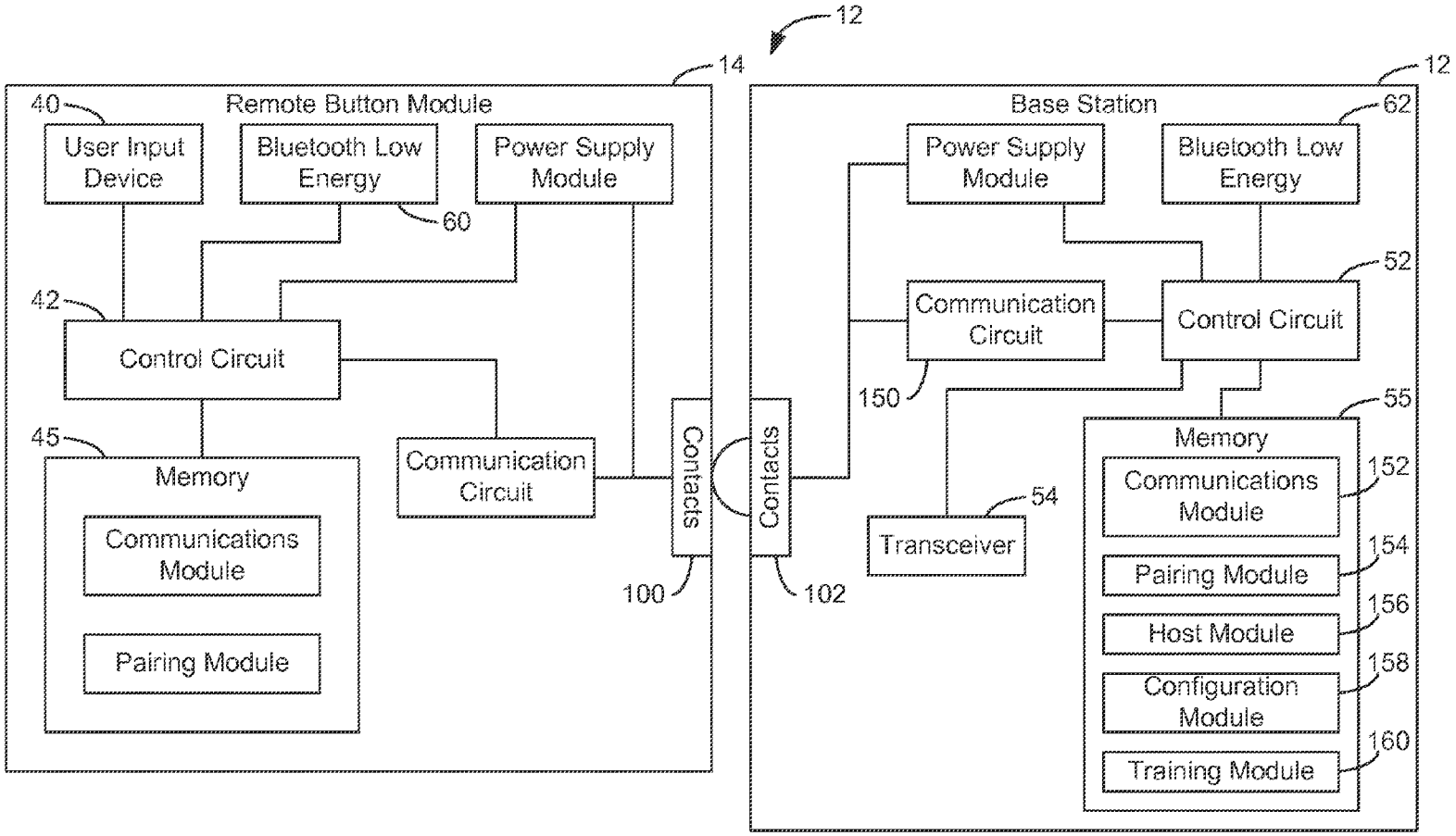
FIG. 10A illustrates one embodiment of the distributed remote system which pairs using an electrical connection between the remote button module and the trainable transceiver base station.

FIG. 10A illustrates one embodiment of the distributed remote system 12 which pairs using an electrical connection between the remote button module 14 and the base station 16. The remote button module 14 and/or the base station 16 may include a communications circuit 150 with allows pairing information to be sent and received through the contacts 102 of the base station 16 and the contact 100 of the remote button module 14. The communications circuit 150 may be controlled by the control circuit 52. The communications circuit 150 may be controlled according to a communications module 152 (e.g., programs, computer code, instructions, or other information) stored within memory 55. The control circuit 52 may implement paring programs, computer code, instructions, or other control mechanisms stored in memory 55 as a pairing module 154. For example, the communications module 152 and/or pairing module 154 may handle pairing requests and acceptances, making the device (e.g., the remote button module 14 or base station 16) visible for pairing, exchanging encryption information, implementing a protocol (e.g., Bluetooth protocol, BLE protocol, etc.), otherwise pairing the remote button module 14, base station 16, and/or other device (e.g., a remote device such as a smart phone), or otherwise contain programs which when run handle pairing and communication between remote button modules 14 and base stations 16. The pairing module 154 may also include device identification information. In some embodiments, the base station 16 may include a host module 156. The host module 156 may be implemented by the control circuit 52 to host a Bluetooth connection (e.g., between the remote button module 14 and the base station 16). The host module 156 may also implement the pairing process (e.g., sending protocol information to the remote button module 14, sending a pairing request, or otherwise facilitating the pairing of remote button modules 14 and base stations 16). In some embodiments, the trainable transceiver base station 16 includes a configuration module 158. The configuration module 158 may contain configuration information related to pairing. For example, the configuration module 158 may contain information for implementing a variety of pairing and/or communications protocols (e.g., Bluetooth v2.0-v4.0, BLE, NFC, or other protocol). In other embodiments, one or more of the above described components may be included in other configurations of the distributed remote system 12 (e.g., a distributed remote system 12 which does not include contacts and pairs by a different procedure). In some embodiments, the memory 55 of the base station 16 further includes a training module 160. The training module 160 may include programs, computer code, instructions, or other information which are used when training the trainable transceiver of the base station 16 or the base station 16 itself. For example, a control signal from an original transmitter which is received by the base station 16 may be analyzed according to a program stored in the training module 160. The analysis may be carried out by one or more of the communication circuit 150, control circuit 52, transceiver circuit, or transceiver 54. In some embodiments, control information (e.g., the frequency of a control signal, encryption information, a device identifier, or other information carried by a control signal) may be stored in the training module 160 or elsewhere in memory 55 for later use. The later use may include formatting or otherwise sending a control signal to a home electronic device and/or remote device based on the control information learned from the transmission of the original transmitter.

Figure 10B:
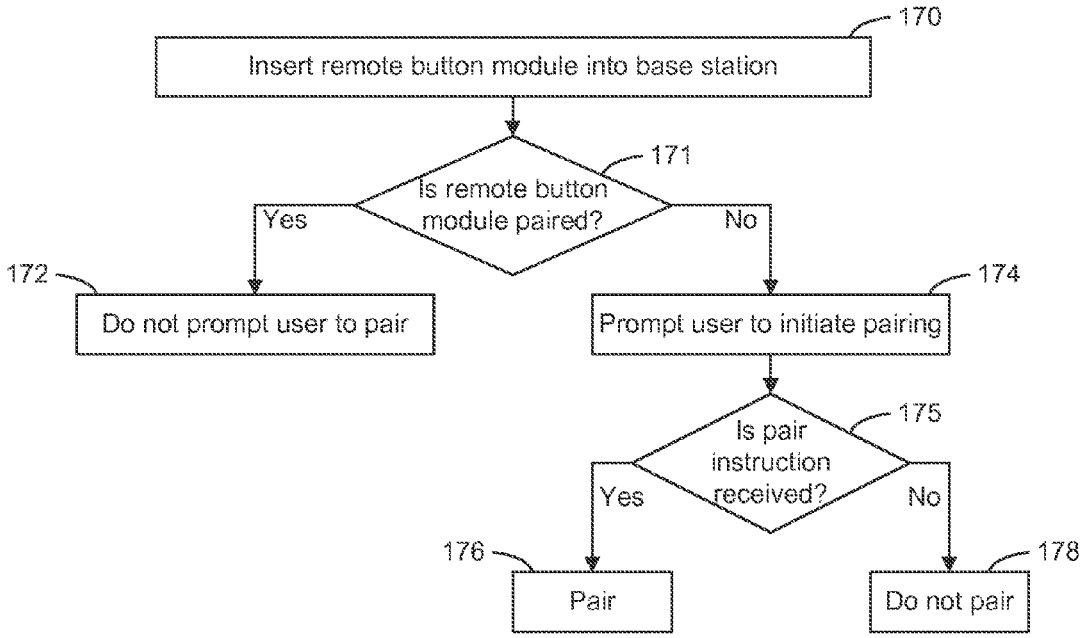
FIG. 10B illustrates a flow chart for one embodiment of the distributed remote system for pairing a remote button module with a base station using contacts.

FIG. 10B illustrates a flow chart for one embodiment of the distributed remote system 12 for pairing a remote button module 14 with a base station 16. The remote button module 14 is inserted into the base station 16 (step 170). This creates an electrical connection between the remote button module 14 and the base station 16. The base station 16 determines if the remote button module 14 has already been paired with the base station 16 (step 171). For example, the base station 16 may send a request for the identification information of the remote button module 14 or receive the information from the remote button module 14. The base station 16 may then check the memory 55 (e.g., the configuration module 158, pairing module 154, host module 156, or other locations in memory 55) for the identification information of the remote button module 14 and determine if the remote button module 14 and the base station 16 have already been paired (e.g., already been paired by a user or prior to being packaged for consumer purchase). If the remote button module 14 and the base station 16 have been previously paired then the base station 16 does not prompt the user to pair (step 172). If the remote button module 14 and the base station 16 are unpaired, the bases station may prompt the user to initiate pairing (step 174). The user may then provide a pairing instruction through an operator input device (e.g., push a button). The base station 16 checks to see if a pair instruction has been received (step 175). If the pair instruction is received from the user, the base station 16 and remote button module 14 are paired (step 176). If no instruction is received or an instruction not to pair is received, then the remote button module 14 and the base station 16 are not paired (step 178). In other embodiments, the remote button module 14 and the base station 16 are paired automatically when the remote button module 14 is inserted into the base station 16. In further embodiments, additional steps are required for strong authentication. For example, a user may also input a PIN into the remote button module 14 that is displayed by the base station 16.

Figure 10C:
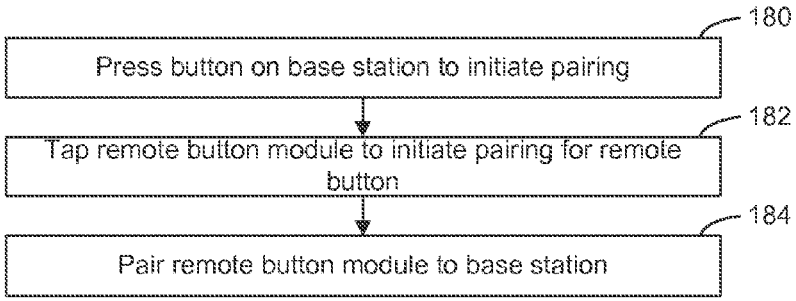
FIG. 10C illustrates a flow chart for pairing a remote button module and base station according to one embodiment of the distributed remote system using a tap input.

FIG. 10C illustrates a flow chart for pairing a remote user interface module and trainable transceiver base station 16 according to one embodiment of the distributed remote system 12. A user presses a button on the base station 16 to initiate pairing (step 180). In other embodiments, the user may initiate pairing through other user inputs (e.g., using a touchscreen, voice command, etc.). The user then taps the remote button module 14 a specified number of times (e.g., 3 times) to initiate pairing the remote button module 14 (step 182). This may put the remote button module 14 in a pairing mode (e.g., make the remote button module 14 discoverable), send a pairing request to discovered devices (e.g., the base station 16 which was made discoverable by the user input), etc. The remote button module 14 and the base station 16 are then paired according to the paring protocol (e.g., the above discussed hardware and software pairs the remote button module 14 and the base station 16) (step 184). In further embodiments, the paring mode of either the base station 16 or the remote button module 14 may be entered into using other user inputs. For example, touchscreen inputs, voice inputs, fingerprint reader inputs, button presses, etc. by the user may initiate pairing.

Figure 10D:
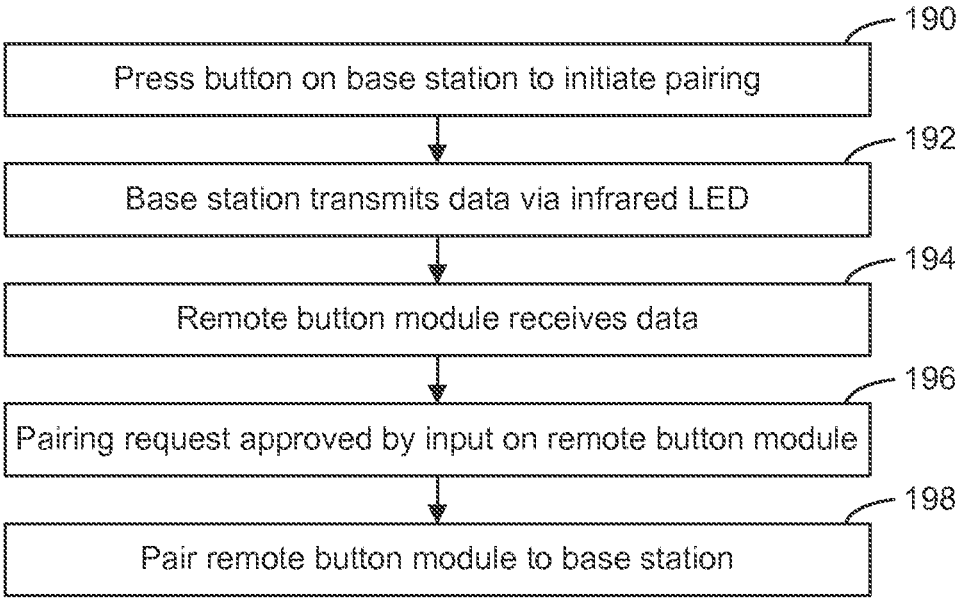
FIG. 10D illustrates a flow chart for pairing a remote button module and base station according to one embodiment of the distributed remote system using an optical transmission.

FIG. 10D illustrates a flow chart for pairing a remote button module 14 and base station 16 according to one embodiment of the distributed remote system 12. A user may initiate pairing by providing an input to the base station 16 (e.g., pressing a pairing button on the base station 16) (step 190). The base station 16 transmits pairing data (e.g., a pairing request) by flashing an LED or other light source (e.g., display) (step 192). For example, the LED may be an infrared LED which communicates to the remote button module 14 using the infrared spectrum. The remote button module 14 receives the data (step 194). For example, the remote may receive the data using a light sensor, a solar cell, infrared sensor, optical transceiver, or other communications device. The user then approves the pairing request by providing an input through an operator input device on the remote button module 14 (e.g., pushing a button) (step 196). In some embodiments, the user may be prompted to provide this input by the remote device (e.g., audio instructions, prompt displayed on a display of the remote button module 14, a flashing LED, or other prompt mechanism). In further embodiments, the user may be prompted by the base station 16. In additional embodiments, no user input is provided, and the remote button module 14 and the base station 16 pair automatically when the remote button module 14 receives the pairing data. The remote button module 14 and the base station 16 are then paired according to the paring protocol (e.g., the above discussed hardware and software pairs the remote button module 14 and the base station 16) (step 198).

Figure 10E:
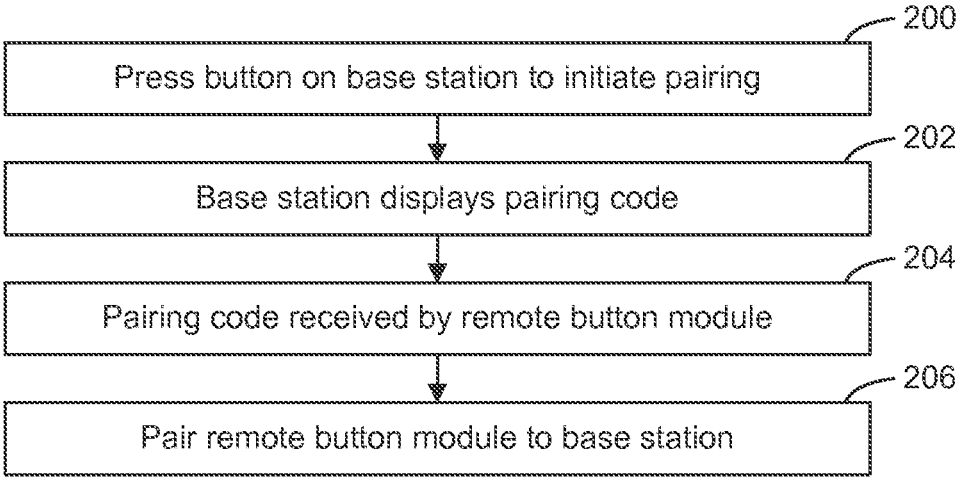
FIG. 10E illustrates a flow chart for pairing a remote button module and base station according to one embodiment of the distributed remote system using code inputs.

FIG. 10E illustrates a flow chart for pairing a remote button module 14 and base station 16 according to one embodiment of the distributed remote system 12. A user may initiate pairing by providing an input to the base station 16 (e.g., pressing a pairing button on the base station 16) (step 200). The base station 16 displays a pairing code (e.g., PIN) (step 202). In some embodiments, the base station 16 displays the pairing code on a display (e.g., LCD display). In other embodiments, the pairing code may be provided to the user using other output devices. For example, the pairing code may be provided by an audio output using a speaker, may be transmitted to a user's smart phone or other remote device already paired to the base station 16 and/or remote button module 14, etc. The pairing code is then received by the remote button module 14 (step 204). In some embodiments, a user enters the pairing code through a series of button presses (e.g., using one button of the remote button module 14 a user may press the button a number of times corresponding to a digit of the code and pause before doing the same for the next digit). In other embodiments, the remote user interface module may receive the pairing code form a remote device (e.g., smart phone) paired to the remote button module 14, a voice command received by a microphone in the remote button module 14, inputs on a touchscreen of the remote button module 14, etc. The remote button module 14 and the base station 16 are then paired according to the paring protocol (e.g., the above discussed hardware and software pairs the remote button module 14 and the base station 16) (step 206).

In some embodiments, the pairing techniques described above may be used in combination. For example, a remote button module 14 and/or trainable transceiver base station 16 may support one or more of the techniques described above. In further embodiments, the above described techniques may be used to pair the remote button module 14 and/or the base station 16 to other devices (e.g., home electronic devices, remote devices, etc.) In further embodiments, other pairing techniques may be used such as pairing which includes thumb print recognition, NFC pairing, voice commands, etc.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can include RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A trainable transceiver base station for controlling remote devices, comprising:

a first transceiver circuit configured to transmit activation signals to a plurality of remote devices;

a power connection configured to receive electrical power from a vehicle; and a control circuit configured to cause the first transceiver circuit to:

select a communication protocol from a plurality of communication protocols based on a command signal and training information, wherein the command signal and the training information are received from a remote button module, wherein each communication protocol specifies transmission characteristics and a security protocol for controlling a corresponding remote device of the plurality of remote devices;

format an activation signal to control a remote device of the plurality of remote devices based on the training information and the selected proper communication protocol; and transmit the activation signal when the command signal is received at the trainable transceiver base station, wherein the trainable transceiver base station is located at a first location within the vehicle, and the remote button module is located at a second location within the vehicle.

2. The trainable transceiver base station of claim 1, wherein the power connection comprises an interface for receiving power from a vehicle power system.

3. The trainable transceiver base station of claim 1, further comprising:

a second transceiver circuit configured to receive the command signal from the remote button module, wherein the second transceiver circuit uses less power than the first transceiver circuit.

4. The trainable transceiver base station of claim 1, wherein the trainable transceiver base station is configured to be trained to control the remote device based on a transmission from an original transmitter associated with the remote device, wherein the transmission is received at the first transceiver circuit, and wherein at least one characteristic of the transmission is stored in memory of the trainable transceiver base station.

5. The trainable transceiver base station of claim 1, wherein the trainable transceiver base station is configured to be trained to control the remote device based on a transmission from an original transmitter associated with the remote device, wherein at least one characteristic of the transmission is received at the trainable transceiver base station from the remote button module, and wherein the at least one characteristic of the transmission is stored in memory of the trainable transceiver base station.

6. The trainable transceiver base station of claim 1, further comprising:

two or more electrical contacts configured to form an electrical connection with the remote button module when corresponding contacts of the remote button module are brought into contact with the two or more electrical contacts of the trainable transceiver base station, wherein the trainable transceiver base station is configured to at least one of:

(a) provide electrical power to a battery of the remote button module via the electrical connection;

(b) receive training information from the remote button module; or (c) pair with the remote button module, wherein the remote button module controls the trainable transceiver base station via command signals when the trainable transceiver base station and the remote button module are paired.

7. A remote button module for controlling remote devices, comprising:

a user input device for controlling a plurality of remote devices;

a transceiver; and a control circuit configured to:

send training information to a trainable transceiver base station;

format a command signal to include a proper communication protocol for an activation signal transmission by the trainable transceiver base station to a remote device of the plurality of remote devices, formatted to cause the trainable transceiver base station to select the proper communication protocol from a plurality of communication protocols based on the training information and an input at the user input device and to transmit the activation signal to the remote device corresponding to the input, wherein each communication protocol specifies transmission characteristics and a security protocol for controlling a corresponding remote device of the plurality of remote devices; and transmit the command signal to the trainable transceiver base station in response to receiving the input at the user input device; and wherein the remote button module is located at a first location within the vehicle and the trainable transceiver base station is located at a second location within the vehicle.

8. The remote button module of claim 7, wherein the remote button module further comprises a power source configured to power the user input device, the control circuit, and the transceiver, wherein the power source includes at least one of a battery, a rechargeable battery, or a solar cell.

9. The remote button module of claim 7, wherein the transceiver is configured to receive a transmission from an original transmitter associated with the remote device, wherein the control circuit is configured to store at least one characteristic of the transmission in memory of the remote button module, and wherein the remote button module is configured to provide the at least one characteristic of the transmission to the trainable transceiver base station.

10. The remote button module of claim 7, further comprising:

two or more electrical contacts configured to form an electrical connection with the trainable transceiver base station when the contacts of the remote button module are brought into contact with two or more corresponding electrical contacts of the trainable transceiver base station, wherein the remote button module is configured to at least one of:

(a) receive electrical power from the trainable transceiver base station and charge a battery of the remote button module with the electrical power;

(b) provide training information to the trainable transceiver base station; or (c) pair with the trainable transceiver base station, wherein the remote button module controls the trainable transceiver base station via command signals when the trainable transceiver base station and the remote button module are paired.

11. The remote button module of claim 7, wherein the user input device includes at least one of a touchscreen with at least one button is formed via a graphical user interface element on the touch screen, a button, or a microphone.

12. The remote button module of claim 7, wherein the remote button module is back lit by at least one of a luminescent material included in a housing of the remote button module, a light emitting diode, or a display screen.

13. The remote button module of claim 7, further comprising:

an attachment mechanism configured to attach the remote button module to the vehicle, wherein the attachment mechanism includes at least one of an adhesive backing attached to the remote button module, or a housing of the remote button module configured to be accepted into a frame with an interface for securing the frame to a vehicle surface.

14. A method of pairing a remote button module with a trainable transceiver base station for controlling remote devices, comprising:

establishing communication between the remote button module and the trainable transceiver base station; and executing a process of pairing the remote button module to the trainable transceiver base station, including exchanging pairing information for a communication protocol for communication between the remote button module and the trainable transceiver base station;

wherein, once paired, the remote button module is configured to send control information to the trainable transceiver and to transmit a command signal to the trainable transceiver base station in response to a user input for controlling a remote device of a plurality of remote devices, wherein the trainable transceiver base station is configured to transmit an activation signal formatted by selecting a proper communication protocol from a plurality of communication protocols determined based on the command signal and the control information to control the remote device in response to receiving the command signal, and wherein each communication protocol specifies transmission characteristics and a security protocol for controlling a corresponding remote device of the plurality of remote devices.

15. The method of claim 14, wherein the process of pairing includes:

inserting the remote button module in the trainable transceiver base station such that an electrical connection is formed between contacts of the remote button module and contacts of the trainable transceiver base station;

determining, using a control circuit, that the inserted remote button module and the trainable transceiver base station have not already been paired; and pairing the remote button module and the trainable transceiver base station via an exchange of pairing information over the electrical connection formed by the contacts.

16. The method of claim 14, wherein the process of pairing includes:

receiving, using a control circuit and a user input device included in the trainable transceiver base station, a user input to pair the trainable transceiver base station;

receiving, using a control circuit and a user input device included in the remote button module, a user input to pair the remote button module;

and pairing the remote button module and the trainable transceiver base station via an exchange of pairing information over wireless communication between the remote button module and the trainable transceiver bases station, wherein the user input to pair the remote button module is at least one of three taps on the remote button module sensed by an accelerometer included in the remote button module, moving the remote button module vertically sensed by the accelerometer, or a gesture performed on a touchscreen of the remote button module.

17. The method of claim 14, wherein the process of pairing includes transmitting electromagnetic radiation in a visible light or infrared spectrum using a light emitting diode coupled to the trainable transceiver base station and receiving the electromagnetic radiation using a solar cell coupled to the remote button module.

18. The method of claim 14, wherein the process of pairing includes displaying a PIN on a user input device of the trainable transceiver base station.

19. The trainable transceiver base station of claim 1, further comprising memory storing additional training information different from the training information received from the remote button module, wherein the additional training information enables the control circuit of the trainable transceiver base station to be compatible with more remote devices than the remote button module is.

20. The remote button module of claim 7, further comprising memory storing the training information different from additional training information stored at the trainable transceiver base station, wherein the additional training information enables the trainable transceiver base station to be compatible with more remote devices than the control circuit of the remote button module.

* * * * *